US007733301B2

(12) United States Patent
Han et al.

(10) Patent No.: US 7,733,301 B2
(45) Date of Patent: Jun. 8, 2010

(54) PLASMA DISPLAY APPARATUS AND DRIVING METHOD THEREOF

(75) Inventors: Jung Gwan Han, Gyeongsangbuk-do (KR); Katsuo Isono, Tokyo (JP)

(73) Assignee: LG Electronics Inc., Seoul (KR)

( * ) Notice: Subject to any disclaimer, the term of this patent is extended or adjusted under 35 U.S.C. 154(b) by 1020 days.

(21) Appl. No.: 11/354,152

(22) Filed: Feb. 15, 2006

(65) Prior Publication Data

US 2006/0256041 A1 Nov. 16, 2006

(30) Foreign Application Priority Data

May 10, 2005 (KR) ..... 10-2005-0038984

(51) Int. Cl.
*G09G 3/28* (2006.01)

(52) U.S. Cl. ..... 345/60; 345/63; 345/67

(58) Field of Classification Search ..... 345/60; 645/60, 63, 67, 204
See application file for complete search history.

(56) References Cited

U.S. PATENT DOCUMENTS

| | | | | |
|---|---|---|---|---|
| 5,113,181 | A | 5/1992 | Inoue et al. | |
| 6,160,530 | A * | 12/2000 | Makino | 345/60 |
| 6,414,653 | B1 * | 7/2002 | Kobayashi | 345/60 |
| 6,611,099 | B1 | 8/2003 | Murata et al. | |
| 6,624,798 | B1 * | 9/2003 | Aoki et al. | 345/60 |
| 2001/0024179 | A1 * | 9/2001 | Nakamura | 345/60 |
| 2002/0000954 | A1 * | 1/2002 | Watabu | 345/60 |
| 2002/0140367 | A1 | 10/2002 | Matsumoto | |
| 2002/0196209 | A1 * | 12/2002 | Ho et al. | 345/60 |
| 2006/0001603 | A1 | 1/2006 | Kang et al. | |
| 2006/0176246 | A1 * | 8/2006 | Shoji et al. | 345/60 |
| 2007/0171149 | A1 * | 7/2007 | Hashimoto et al. | 345/60 |

FOREIGN PATENT DOCUMENTS

| | | | |
|---|---|---|---|
| EP | 0837443 | A1 | 4/1998 |
| JP | 7-134566 | A | 5/1995 |
| JP | 11-65516 | A | 3/1999 |
| JP | 2001-51648 | A | 2/2001 |
| KR | 2001-0001585 | A | 1/2001 |

* cited by examiner

*Primary Examiner*—Amare Mengistu
*Assistant Examiner*—Koosha Sharifi
(74) *Attorney, Agent, or Firm*—Birch, Stewart, Kolasch & Birch, LLP

(57) ABSTRACT

The present invention relates to a plasma display apparatus and driving method thereof, wherein rising and/or falling times of data pulses applied to address electrodes in an address period are controlled to reduce noise generation. Thus, address discharge is stabilized, discharge efficiency of plasma display panel is enhanced, and electrical damage to data drive ICs is prevented. The plasma display apparatus includes a plasma display panel including a plurality of address electrodes, a data driving unit including a plurality of data drive ICs that has a plurality of channels, wherein the data drive ICs are electrically connected to the address electrodes through the channels and drive the address electrodes, and a data pulse controller that controls the voltage-rising time and/or the voltage-falling time of the data pulses applied to the plurality of the address electrodes in an address period to be a sufficient duration, e.g. 100 ns or longer, by controlling the data driving unit.

18 Claims, 20 Drawing Sheets

PLASMA DISPLAY APPARATUS AND DRIVING METHOD THEREOF

CROSS-REFERENCES TO RELATED APPLICATIONS

This Nonprovisional application claims priority under 35 U.S.C. §119(a) on Patent Application No. 10-2005-0038984 filed in Korea on May 10, 2005, the entire contents of which are hereby incorporated by reference.

BACKGROUND OF THE INVENTION

1. Field of the Invention

The present invention relates to a plasma display panel, and more particularly, to a plasma display apparatus and driving method thereof, which can control rising and falling times (durations) of data pulses applied to address electrodes in an address period, thereby reducing noise generation, stabilizing address discharges, and preventing electrical damage to driving circuits.

2. Background of the Related Art

Generally, a plasma display panel includes barrier ribs formed between a front substrate and a rear substrate. Together, the barrier ribs and the front and rear substrates form cells. Each of the cells is filled with a primary discharge gas such as neon (Ne), helium (He) or a mixed gas comprising Ne and He. In addition, each cell contains an inert gas comprising a small amount of xenon. If the inert gas is discharged using a high voltage, vacuum ultraviolet rays are generated. The ultraviolet rays excite light-emitting phosphors formed between the barrier ribs to display an image. Plasma display panels can be made thin and slim, and have thus been in the spotlight as one of the next-generation of display devices.

FIG. 1 is a perspective view illustrating the construction of a related art plasma display panel. In FIG. 1, the related art plasma display panel includes a front substrate 100 in which a plurality of pairs of display electrodes, which are formed by a plurality of pairs of scan electrodes 102 and sustain electrodes 103, are arranged on a front glass 101 that serves as a display surface on which the images are displayed. The plasma display panel also includes a rear substrate 110, in which a plurality of address electrodes 113 cross the plurality of display electrodes, is arranged on a rear glass 111 forming a rear surface. The front substrate 100 and the rear substrate 110 are parallel to each other with a predetermined distance therebetween.

The front substrate 100 includes the pairs of the scan electrodes 102 and the sustain electrodes 103 to perform discharge against the other mutually and maintain emission in one discharge cell. The scan electrode 102 and the sustain electrode 103 each has a transparent electrode "a" made of a transparent ITO material and a bus electrode "b" made of a metal material, and the scan and sustain electrodes 102, 103 are formed in pairs. The scan electrodes 102 and the sustain electrodes 103 are covered with one or more dielectric layers 104 to limit a discharge current and to provide insulation among the electrode pairs. A protection layer 105, on which magnesium oxide (MgO) is deposited to facilitate a discharge condition, is formed on the dielectric layer 104.

On the rear substrate 110, barrier ribs 112—of a stripe type or well type—forming a plurality of discharge spaces, i.e., discharge cells, are arranged in a parallel manner. Further, a plurality of address electrodes 113, which perform address discharging to generate the vacuum ultraviolet rays, are disposed parallel to the barrier ribs 112. Red (R), green (G) and blue (B) phosphors 114, which emit visible rays for image display upon address discharging, are coated on a top surface of the rear substrate 110. A low dielectric layer 115 to protect the address electrodes 113 is formed between the address electrodes 113 and the phosphors 114.

A method for implementing image gray scales using the related art plasma display panel will now be described with reference to FIG. 2. As shown in FIG. 2, in order to represent the gray scales of the image in the related art plasma display panel, one frame period is divided into a plurality of sub-fields each having a different number of emission. Each sub-field is subdivided into a reset period for initializing all cells, an address period for selecting discharged cells, and a sustain period for implementing gray scales according to the number of discharges. For example, if it is desired to display an image with 256 gray scales, a frame period (16.67 ms) corresponding to 1/60 second is divided into eight sub-fields SF1 to SF8 as shown in FIG. 2. Each of the eight sub-fields SF1 to SF8 is subdivided into the reset, address and sustain periods as indicated above.

The reset period and the address period of each of the sub-fields are the same for every sub-field. Address discharge for selecting cells to be discharged is generated due to a voltage difference between the address electrodes 113 and transparent electrodes "a" of the scan electrodes 102. The sustain period increases by a ratio of $2^n$ (where, n=0, 1, 2, 3, 4, 5, 6, 7) in each of the sub-fields. Because the sustain period is varied in each sub-field, the gray scale of an image is represented by adjusting the sustain period of each of the sub-fields, i.e., by adjusting the number of sustain discharges. A driving waveform in the method of driving the related art plasma display panel will be described below with reference to FIG. 3.

Referring to FIG. 3, the plasma display panel is driven in the following manner: each sub-field is divided into a reset period for initializing all cells, an address period for selecting cells to be discharged, a sustain period for maintaining the discharge of the selected cells, and an erase period for erasing wall charges within discharged cells.

The reset period is further divided into a set-up period and a set-down period. In the set-up period of the reset period, a ramp-up waveform Ramp-up is applied to all scan electrodes 102 simultaneously. A weak dark discharge is generated within discharge cells of the entire screen due to the ramp-up waveform. The set-up discharge causes positive polarity wall charges to be accumulated on the address electrodes 113 and the sustain electrodes 103 and also causes negative polarity wall charges to be accumulated on the scan electrodes 102.

In the set-down period of the reset period, a ramp-down waveform Ramp-down is applied to all scan electrodes 102. The ramp-down waveform is such that the voltage on the scan electrodes 102 falls from a positive voltage that is below the peak voltage of the ramp-up waveform to a voltage below the ground level voltage GND. The ramp-down waveform applied to the scan electrodes 102 causes a weak erase discharge to occur within the cells. As a result, excessive wall charges formed on the scan electrodes 102 are sufficiently erased. The set-down discharge also causes wall charges to remain within the cells uniformly to the degree in which stable address discharge can be generated.

In the address period of each sub-field, while a negative scan pulse is sequentially applied to the scan electrodes 102, a positive data pulse—synchronized with the negative scan pulse—is applied to the address electrodes 113. As a voltage difference between the scan pulse and the data pulse and a wall voltage generated in the reset period are added, address discharging is generated within the discharge cells to which the data pulses are applied. Further, wall charges of the degree in which discharge can be generated when a sustain voltage Vs is applied are formed within the cells selected by the address discharging. A positive polarity voltage Vz is applied to the sustain electrodes 103 so that erroneous discharge is not generated with the scan electrode 102 by reducing a voltage difference with the scan electrode 102 during the address period.

In the sustain period, a sustain pulse Sus is alternately applied to the scan electrodes 102 and the sustain electrodes 103. In the cells selected by address discharging, a sustain discharge, i.e., a display discharge, is generated between the scan electrodes 102 and the sustain electrodes 103 whenever each sustain pulse is applied as the wall voltage within the cells and the sustain pulse are added.

After the sustain discharge is completed, in the erase period, an erase ramp waveform Ramp-ers, which has a narrow pulse width and a low voltage level, is applied to the sustain electrodes 103 so that wall charges remaining in the cells of the entire screen are erased.

In this related art driving waveform, application time points of the data pulses applied to the address electrodes 113 in the address period will be described with reference to FIG. 4. As shown in FIG. 4, the data pulse applied in the address period rises at a tilt and also falls at a tilt. This related art data pulse has a voltage-rising time or duration (tup) and a voltage-falling time or duration (tdown) that are relatively short. For example, the tup and tdown times of the related art data pulse can be approximately 20 ns.

Furthermore, the related art data pulse is the same for all address electrodes. This situation will be described with reference to FIG. 5, which is a view for explaining the voltage-rising time and the voltage-falling time of data pulses applied to the address electrodes during the address period in the related art driving waveform.

As shown in FIG. 5, the data pulses with identical voltage-rising times tup and identical voltage-falling times tdown are applied to all address electrodes X1 to Xm. In FIG. 5, the data pulses applied to address electrodes X1, X2, X3 . . . Xm all begin rising at a time point t1 and then reach the highest point at a time point t2. That is, the voltage-rising time tup is t2–t1 for all electrodes. Furthermore, the data pulses all begin falling at a time point t3 and then reach the lowest point at a time point t4. That is, the voltage-falling time tdown is t4–t3 for all electrodes.

As such, in the related art, the tup and tdown times of the data pulses are relatively short and same for all data pulses applied to all the address electrodes. As a result, a significant amount of noise is generated. Noise generation due to the data pulses will be described with reference to FIG. 6.

From FIG. 6, it can be seen that a relatively large amount of noise is generated in the data pulses applied to the address electrodes. That is, when the data pulse rises, some noise is generated in the direction of the rising voltage (overshoot). When the data pulse falls, some noise is generated in the direction of the falling voltage (undershoot). The noise is generated due to the coupling of the data pulses applied to address electrodes at points where the voltage of the data pulses abruptly change, i.e. at points where the voltage falls and where the voltage rises.

If a difference between the highest value of rising noise and the lowest value of falling noise, i.e., the amount of noise Vr, becomes excessive, the address discharge generated during the address period becomes unstable. As a result, driving efficiency of plasma display panel is reduced. Also, electrical damage to the data drive ICs that supply the data pulses to the address electrodes can occur. Components having high voltage ratings can be used to prevent such electrical damage to the data drive ICs. However, utilizing such components increases the cost of production.

SUMMARY OF THE INVENTION

The present invention provides a plasma display apparatus in which a voltage-rising time (duration) and a voltage-falling time (duration) of data pulses applied to address electrodes in the address period are controlled to reduce generation of noise.

According to an embodiment of the present invention, there is provided a plasma display apparatus, including a plasma display panel including a plurality of address electrodes, a data driving unit including a plurality of data drive ICs that has a plurality of channels, respectively, wherein the data drive ICs are electrically connected to the address electrodes through the channels and drive the address electrodes, and a data pulse controller configured to control one or more of a voltage-rising time and a voltage-falling time of data pulses applied to the plurality of the address electrodes in an address period to be 100 ns or longer, by controlling the data driving unit.

In this case, the data pulse controller controls the voltage-rising time and the voltage-falling time of the data pulses applied to the plurality of the address electrodes in the address period to be the same.

Furthermore, the data pulse controller applies data pulses to the plurality of the address electrodes with the address electrodes being divided into a plurality of address electrode groups where each address group includes one or more address electrodes.

Furthermore, the data pulse controller controls the voltage-rising time of data pulses applied to one or more of the plurality of the address electrode groups to be different from those of other address electrode groups, or the voltage-falling time of data pulses applied to one or more of the plurality of the address electrode groups to be different from those of other address electrode groups.

Furthermore, the data pulse controller controls the voltage-rising time of data pulses applied to one or more of the plurality of the address electrode groups to be different from those of other address electrode groups, and the voltage-falling time of data pulses applied to one or more of the plurality of the address electrode groups to be different from those of other address electrode groups.

Furthermore, the data pulse controller controls the plurality of the address electrode groups where the number of address groups range from 2 to a total number of the address electrodes.

Furthermore, the number of the address electrode groups range from 4 to 8.

Furthermore, the address electrode groups have between 100 to 1000 address electrodes in the group.

Furthermore, all the address electrode groups to have the same number of the address electrodes, or one or more of the address electrode groups to have a different number of the address electrodes.

Furthermore, the data pulse controller controls the voltage-rising time and the voltage-falling time of data pulses applied to all the address electrodes included in the same address electrode group to be the same.

Furthermore, the data pulse controller controls a difference between the voltage-rising times of the data pulses applied to the plurality of the address electrode groups to be substantially regular.

Furthermore, the data pulse controller controls a difference between the voltage-falling times of the data pulses applied to the plurality of the address electrode groups to be substantially regular.

Furthermore, the data pulse controller controls the voltage-falling time of the data pulse to be shorter when the voltage-rising time of the data pulses is longer.

Furthermore, the data pulse controller controls all pulse widths of the data pulses applied to the plurality of the address electrode groups to be at least a predetermined duration.

Furthermore, the number of the channels of the data drive ICs is 150 or higher.

According to an embodiment of the present invention, there is provided a method of driving a plasma display panel including a plurality of address electrodes, wherein the voltage-rising time and/or the voltage-falling time of data pulses applied to the plurality of the address electrodes through a plurality of channels of a plurality of data drive ICs in an address period is 100 ns or longer.

Furthermore, the voltage-rising time and the voltage-falling time of the data pulses applied to the plurality of the address electrodes in the address period are the same.

Furthermore, the data pulses are applied to the plurality of the address electrodes with the address electrodes being divided into a plurality of address electrode groups where each group includes one or more address electrodes.

Furthermore, the voltage-rising time of data pulses applied to one or more of the plurality of the address electrode groups is different from those of other address electrode groups, or the voltage-falling time of data pulses applied to one or more of the plurality of the address electrode groups is different from those of other address electrode groups.

Furthermore, the voltage-rising time of data pulses applied to one or more of the plurality of the address electrode groups is different from those of other address electrode groups, and the voltage-falling time of data pulses applied to one or more of the plurality of the address electrode groups is different from those of other address electrode groups.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

A plasma display apparatus and driving method thereof according to various embodiments of the present invention will now be described in detail with reference to the accompanying drawings.

Figure 7:
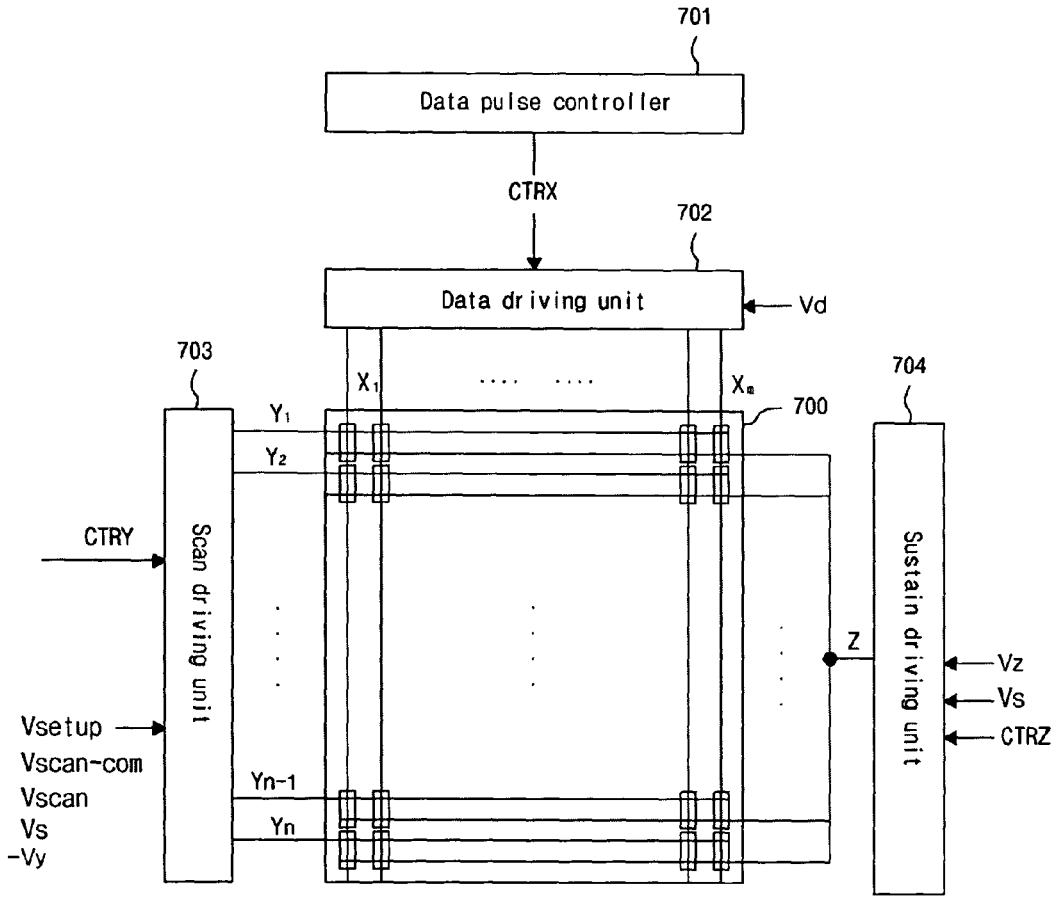
FIG. 7 is a block diagram showing a construction of a plasma display apparatus according to an embodiment of the present invention.
Figure 7:
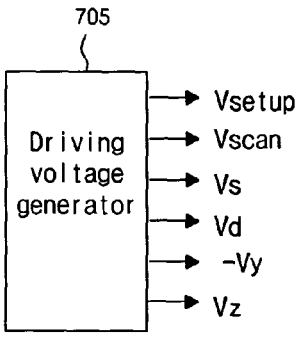

FIG. 7 is a block diagram showing the construction of a plasma display apparatus according to an embodiment of the present invention. As shown in FIG. 7, the plasma display apparatus includes a plasma display panel 700. The plasma display panel 700 includes a plurality of scan electrodes Y1 to Yn, a sustain electrode Z, and a plurality of address electrodes X1 to Xm crossing the scan electrodes Y1 to Yn and the sustain electrode Z. The sustain electrode Z can be implemented as a common electrode. The plasma display panel 700 displays an image through applying driving pulses to the address electrodes X1 to Xm, the scan electrodes Y1 to Yn and the sustain electrode Z in the reset, address and sustain periods of a subfield. The plasma display apparatus also includes a data driving unit 702 that applies data pulses to the address electrodes X1 to Xm, a scan driving unit 703 that drives the scan electrodes Y1 to Yn, a sustain driving unit 704 that drives the sustain electrode Z, a data pulse controller 701 that controls the data driving unit 702, and a driving voltage generator 705 that supplies necessary driving voltages to the driving units 702, 703 and 704.

The plasma display apparatus displays image frames through a combination of one or more subfields where driving pulses are applied to the address electrodes X1 to Xm, the scan electrodes Y1 to Yn or the sustain electrode Z in the reset, address and sustain periods. In the present embodiment, the voltage-rising time tup and/or the voltage-falling time tdown of data pulses applied to the plurality of the address electrodes X1 to Xm in the address period of a sub-field are controlled to be a predetermined minimum duration or longer by controlling the data driving unit 702. The predetermined minimum rising and/or falling duration is preferred to be at least 100 ns. The reason for controlling the tup and/or the tdown times of the data pulses will be explained below.

The aforementioned plasma display panel 700 includes a front panel (not shown) and a rear panel (not shown), which are combined together with a predetermined gap therebetween. Each of the scan electrodes Y1 to Yn is paired with the sustain electrode Z. The scan electrodes Y1 to Yn and the sustain electrode Z cross the address electrodes X1 to Xm.

Image data, which undergo inverse gamma correction and error diffusion through an inverse gamma correction circuit (not shown), an error diffusion circuit (not shown), etc. and mapped to respective subfields by a subfield mapping circuit (not shown), are provided to the data driving unit 702. The data driving unit 702 includes a plurality of data drive ICs having a plurality of channels electrically connected to the address electrodes X1 to Xm. The data driving unit 702 applies data pulses to the address electrodes X1 to Xm through the channels of the data drive ICs. The data driving unit 702 samples and latches the data in response to a data timing control signal CTRX from the data pulse controller 701 and applies the data pulses to the address electrodes X1 to Xm.

The scan driving unit 703 applies a ramp-up waveform Ramp-up and a ramp-down waveform Ramp-down to the scan electrodes Y1 to Yn during the reset period. Furthermore, the scan driving unit 703 sequentially applies a scan pulse Sp of a voltage −Vy to the scan electrodes Y1 to Yn during the address period, and applies a sustain pulse Sus to the scan electrodes Y1 to Yn during the sustain period.

The sustain driving unit 704 applies a sustain voltage Vs to the sustain electrode Z during the reset period and a bias voltage Vz during the address period under the control of the timing controller (not shown). The sustain driving unit 704 also applies the sustain pulse Sus to the sustain electrode Z alternating with the scan driving unit 703 during the sustain period.

The data pulse controller 701 generates and provides control signals to the data driving unit 702 for controlling synchronization in the reset period, the address period and the sustain period. More particularly, the data pulse controller 701 controls the tup and/or the tdown times of the data pulses applied to the plurality of address electrodes in the address period to be 100 ns or higher by controlling the data driving unit 702.

The timing control signal CTRX includes a sampling clock for sampling data, a latch control signal, and a switch control signal for controlling on/off time of an energy recovery circuit and a driving switch element (not shown).

The driving voltage generator 705 generates the set-up voltage Vsetup, the scan reference voltage Vsc, the scan voltage −Vy, the sustain voltage Vs, the bias voltage Vz, the data voltage Vd and the like. These driving voltages may vary depending upon the composition of the discharge gas or the structure of the discharge cells.

As indicated above, the data pulse controller 701 controls the data driving unit 702 for controlling synchronization in the address period, and supplies the timing control signal to the data driving unit 702. More particularly, the data pulse controller 701 transmits control signals to control the tup and/or the tdown times of the data pulses applied to the plurality of address electrodes in the address period to be of some minimum duration, e.g. 100 ns, or longer.

In addition, the data pulse controller 701 controls the timings of the data pulses applied to the plurality of address electrode groups. As an illustration, the plurality of address electrodes may be divided into a plurality address electrode groups where each address electrode group includes at least one address electrode. The data pulse controller 701 can control the data driving unit 702 so that the data pulses applied to each address electrode group are different from the data pulses applied to any other address electrode group. For example, the tup times may differ, the tdown times may differ, data pulse start times may differ, data pulse end times may differ, or any combination of differences may be controlled.

The function of the plasma display apparatus according to an embodiment of the present invention will become clear with a description of a subsequent driving method.

Figure 8:
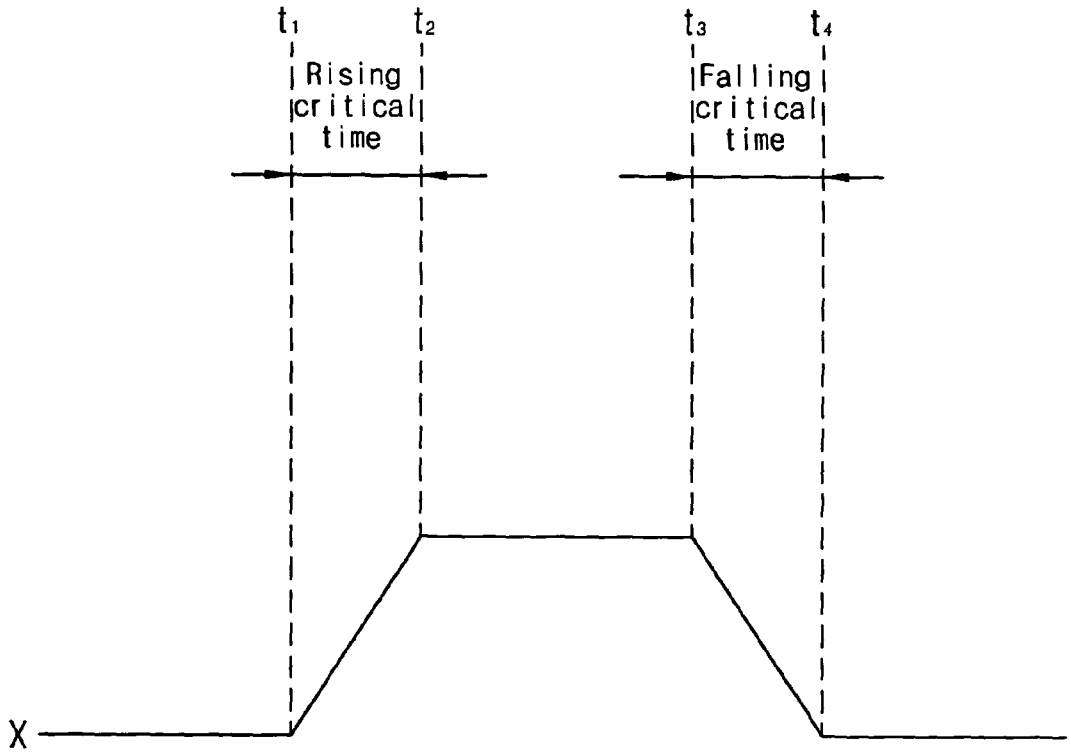
FIG. 8 is a view for explaining a driving method that is performed by the plasma display apparatus shown in FIG. 7 according to an embodiment of the present invention.

FIG. 8 is a view for explaining the driving method that is performed by the plasma display apparatus of FIG. 7 according to an embodiment of the present invention.

In this driving method, one or both of the tup and tdown times of the data pulses applied to the plurality of the address electrodes during the address period is set to be 100 ns or longer. As such, only the tup time of the data pulse can be set to be 100 ns or longer, or only the tdown time can be set to be 100 ns or longer, or both tup and tdown times of the data pulses can be set to be 100 ns or longer. It is preferred that both tup and tdown times are set to be 100 ns or longer.

For example, as shown in FIG. 8, the data pulse applied to the address electrode X begins rising at a time point t1, reaches a maximum at a time point t2, begins falling at a time point t3, and then reaches a minimum at a time point t4. The voltage-rising time tup=t2−t1 of the data pulse is preferred to be 100 ns or longer and the voltage-falling time tdown=t4−t3 is also preferred to be 100 ns or longer. The tup and tdown times of the data pulses applied to all of the plurality of address electrodes can be the same in this instance.

Figure 1:
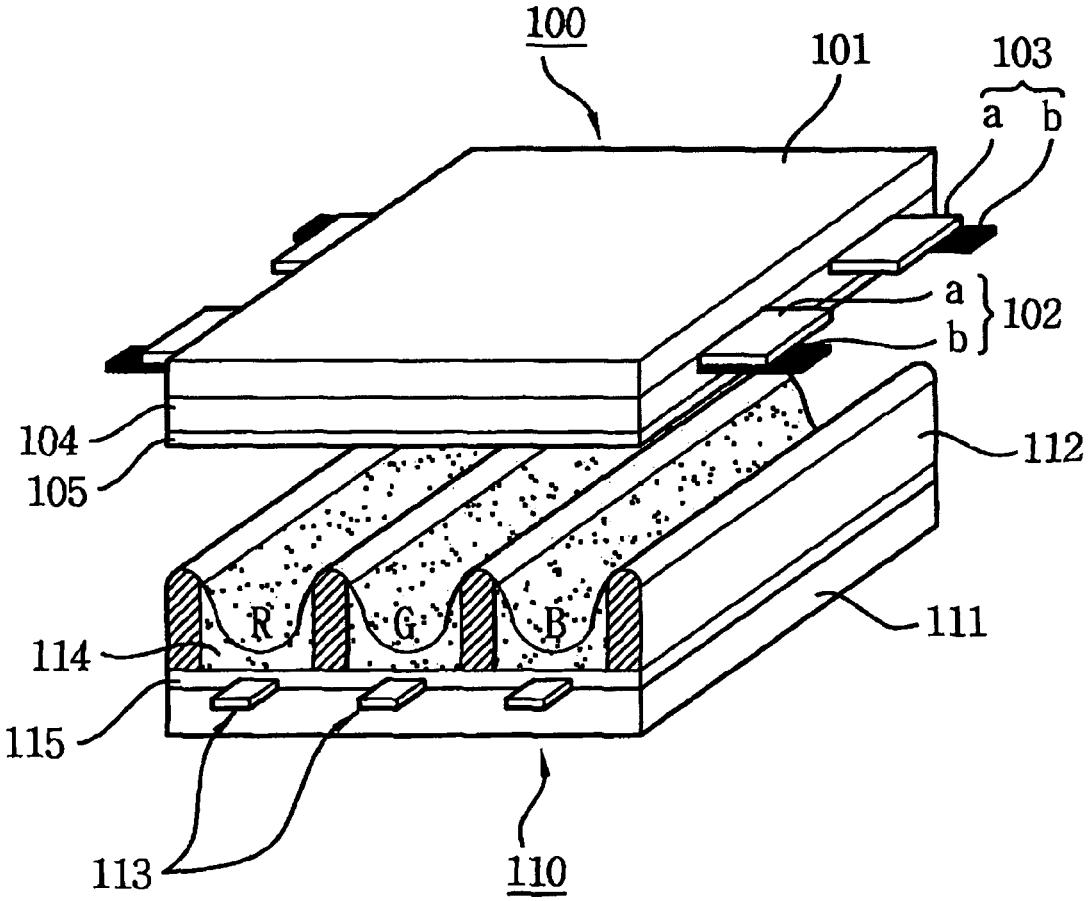
Fig. 1 RELATED ART
FIG. 1 is a perspective view showing the construction of a related art plasma display panel.
Figure 2:
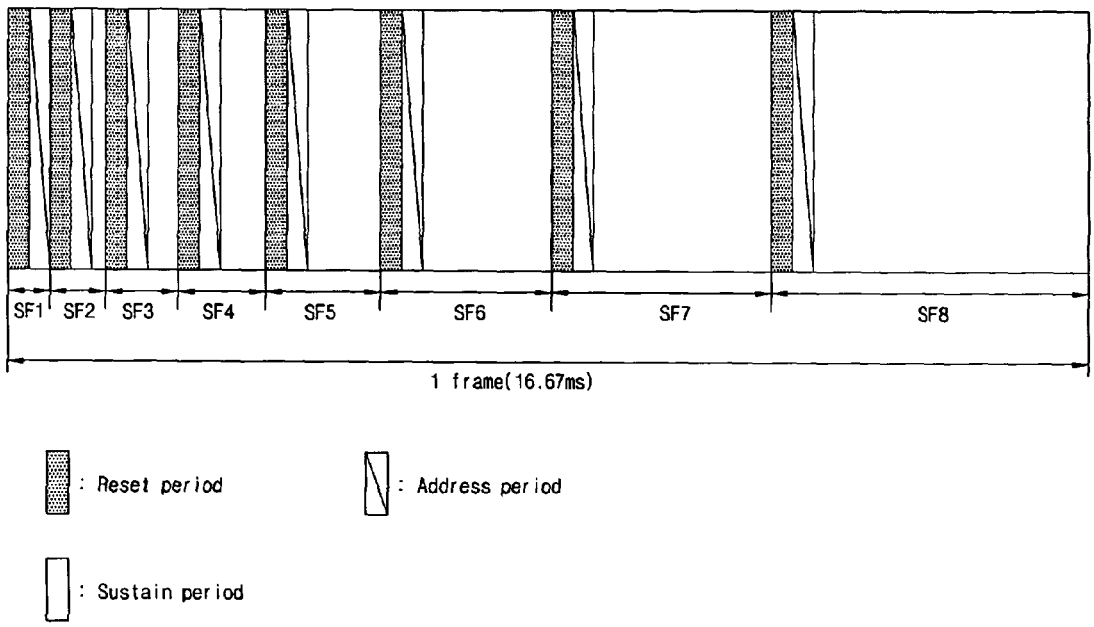
Fig. 2 RELATED ART
FIG. 2 is a view for explaining a method for implementing image gray scales in the related art plasma display panel.
Figure 3:
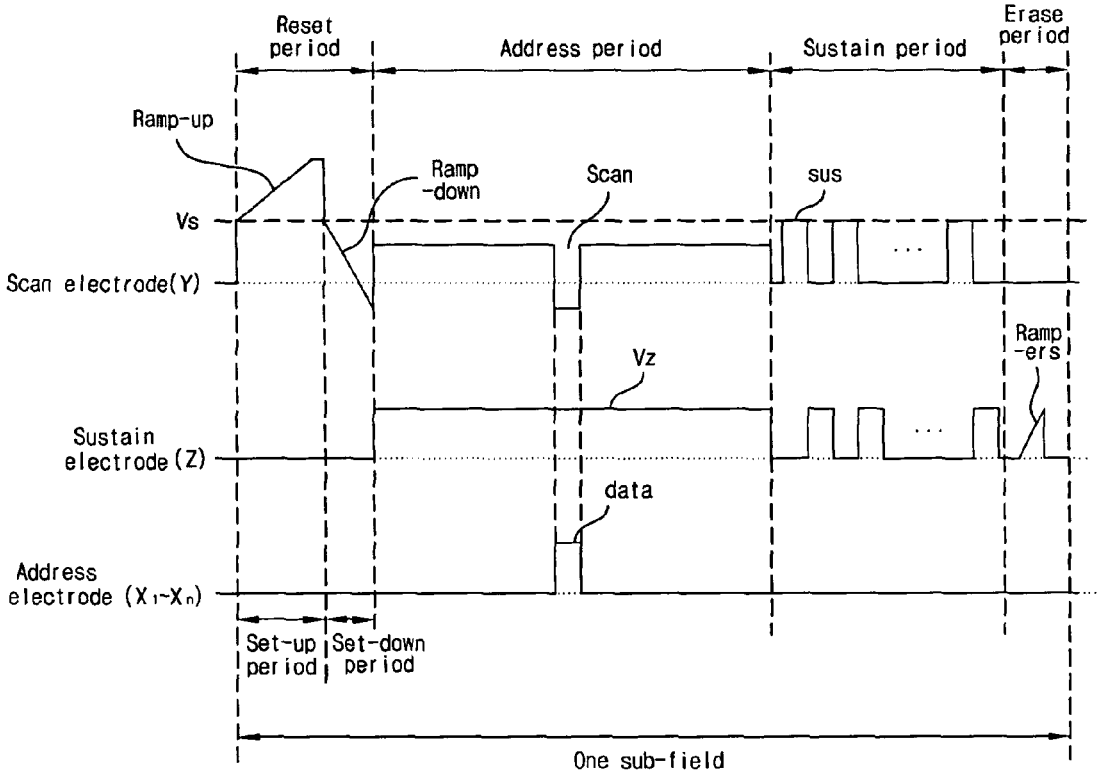
Fig. 3 RELATED ART
FIG. 3 is a view showing a driving waveform in the method of driving the related art plasma display panel.
Figure 4:
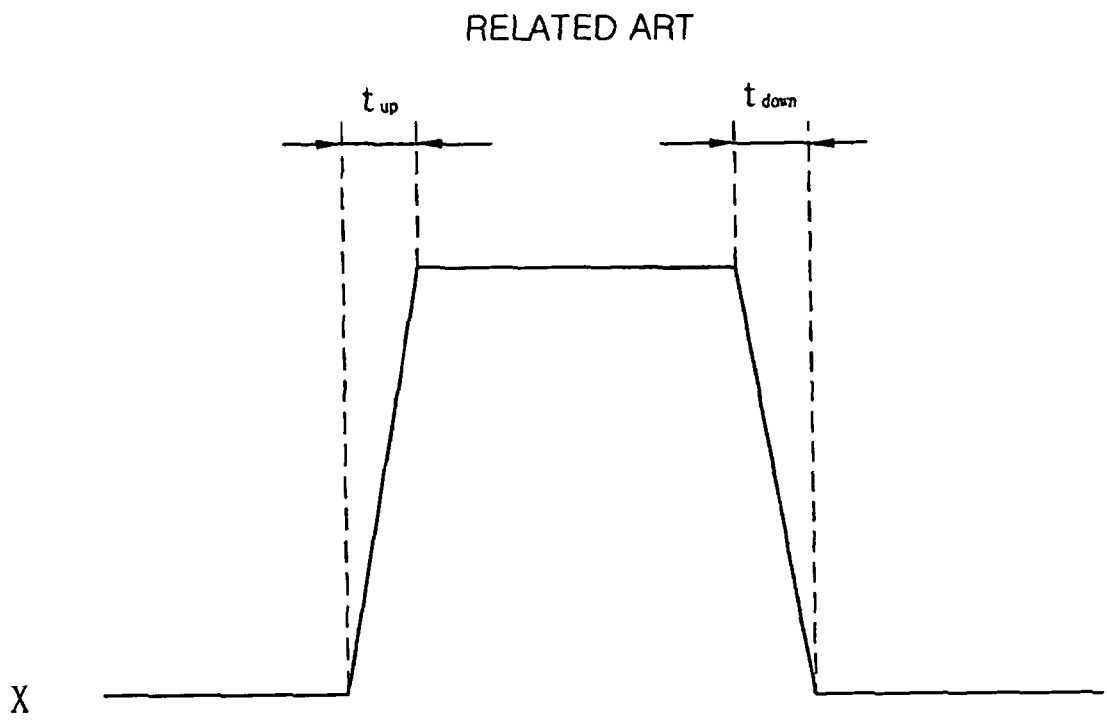
FIG. 4 is a view for explaining, in more detail, a data pulse applied during an address period in the related art driving waveform.
Figure 5:
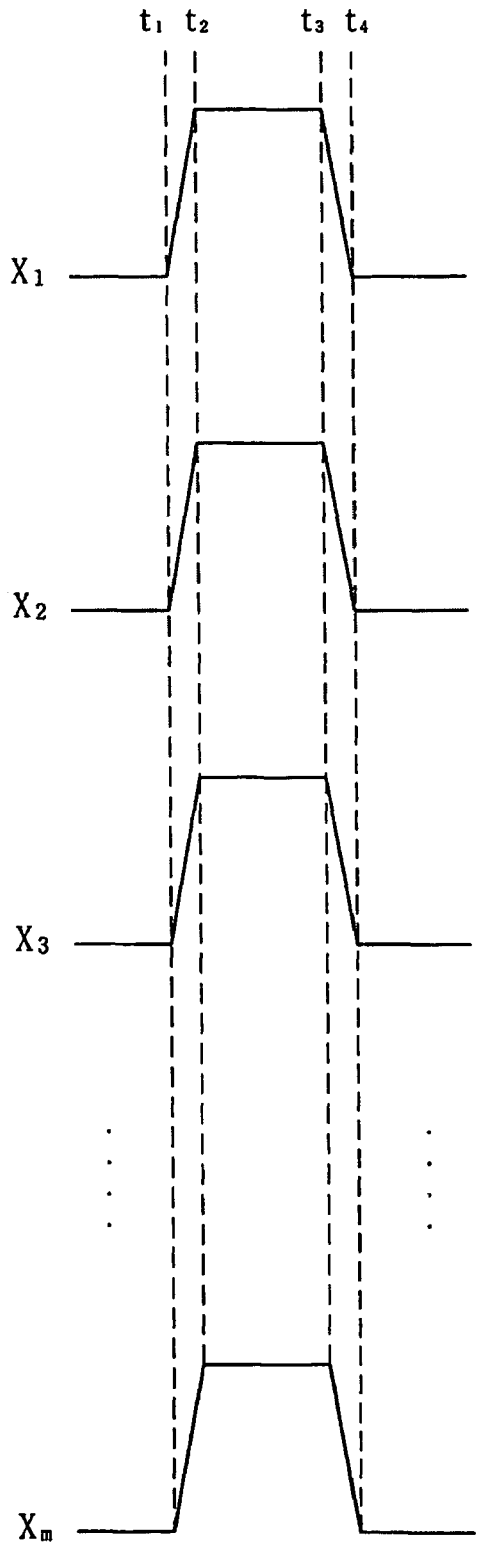
Fig. 5 RELATED ART
FIG. 5 is a view for explaining the voltage-rising time and the voltage-falling time of data pulses applied to the address electrodes during the address period in the related art driving waveform.
Figure 6:
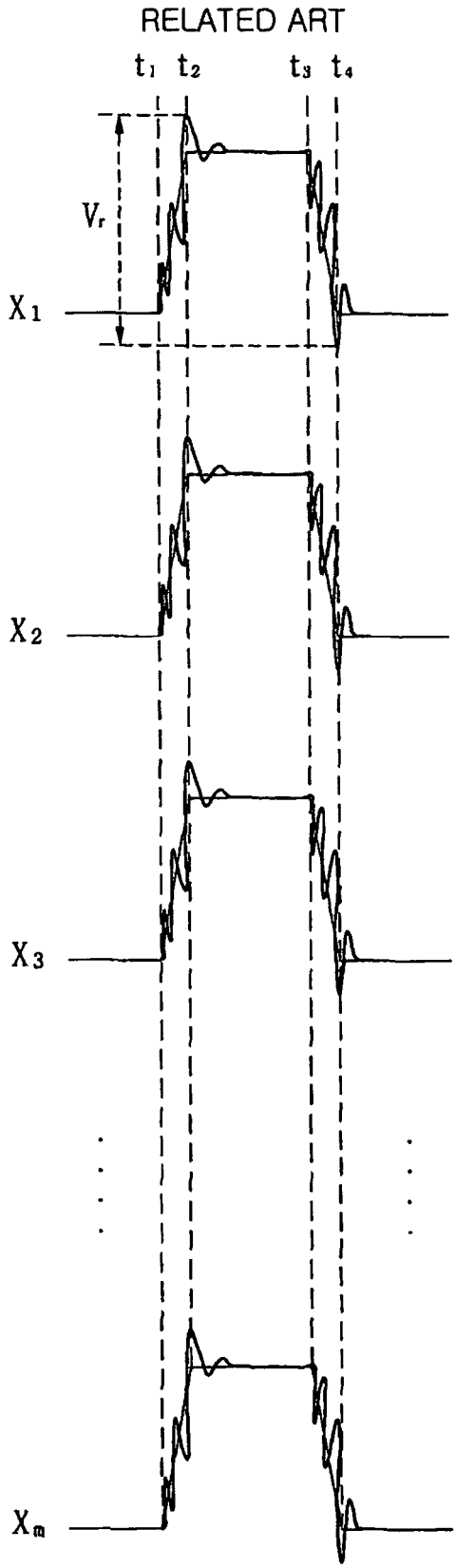
FIG. 6 is a view for explaining noise generation due to the data pulses applied to the address electrodes during the address period in the related art driving waveform.
Figure 9:
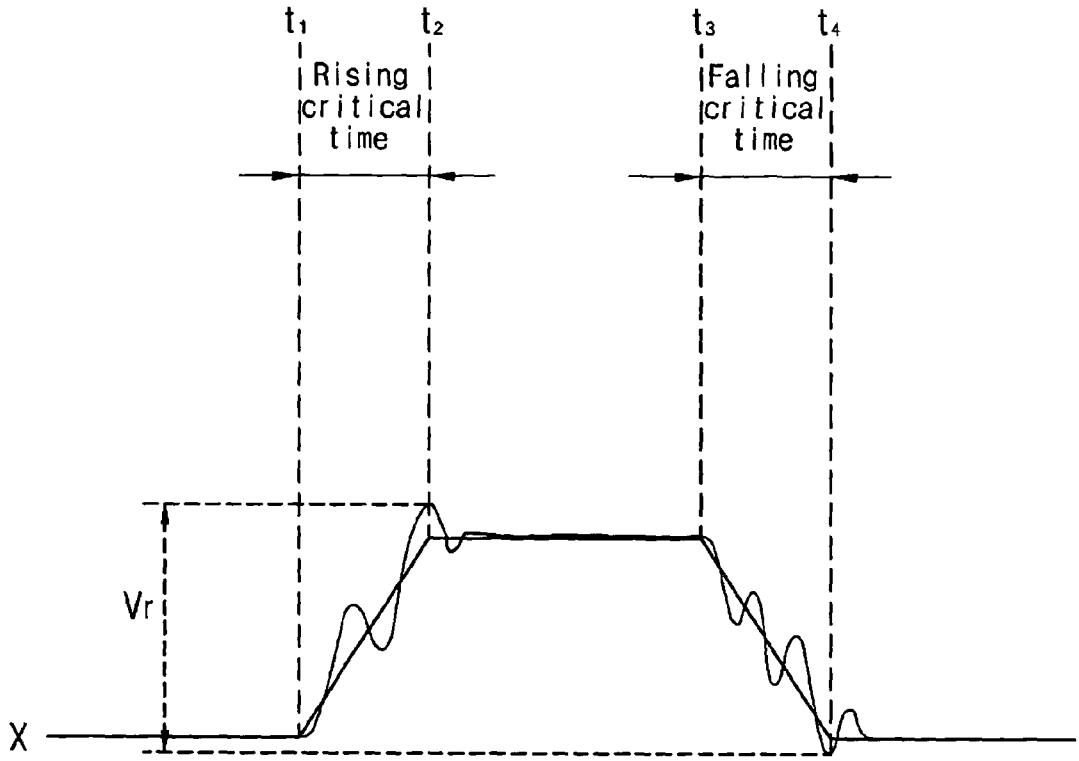
FIG. 9 is a view for explaining noise generation due to the data pulses in the driving waveform of FIG. 8 according to an embodiment of the present invention.

FIG. 9 is a view for explaining noise generated due to the data pulses in the driving waveform of FIG. 8 according to an embodiment of the present invention. In FIG. 9, it can be seen that noise generated in the data pulse applied to the address electrodes is significantly reduced compared the noise generated in the related art device of FIG. 6. That is, as the tup time of the data pulse is increased, e.g. 100 ns or longer, the amount of noise generated in the voltage rising direction is reduced. Also, the amount noise generated in the voltage falling direction is reduced as the tdown time is increased. Accordingly, The total noise Vr is reduced resulting in stable address discharges being generated. As such, the driving efficiency of the plasma display panel is enhanced and electrical damage to data drive ICs that supply the data pulses to the address electrodes is prevented or minimized. This results in improved reliability of the entire plasma display panel.

In the above example, noise reduction is achieved by controlling one or both of the tup and tdown times of the data pulse applied during the address period. Note that the noise reduction is achieved even if the all address electrodes are applied with the same data pulse. However, further noise reduction can be achieved by applying differing data pulses to the address electrodes. This driving method will be described with reference to FIG. 10. Only two electrodes are illustrated for simplicity. However, this is applicable to more than two address electrodes.

Figure 10:
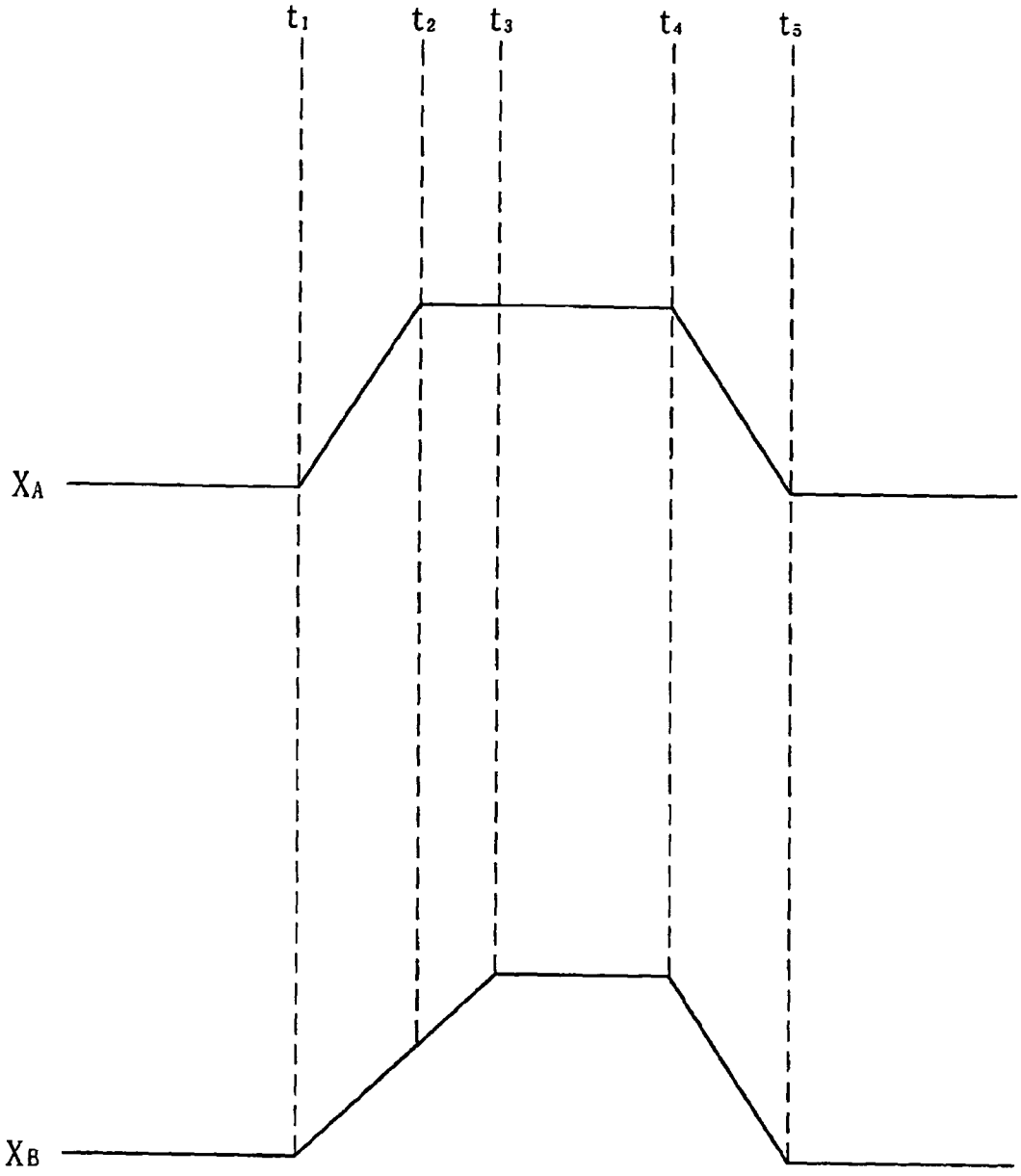
FIG. 10 is a view for explaining a difference between voltage-rising times of data pulses applied to two address electrodes according to an embodiment of the present invention.

Referring to FIG. 10, the voltage-rising times of the data pulses applied to two address electrodes $X_A$ and $X_B$ on the plasma display panel are different from each other. For convenience, the data pulses applied to the $X_A$ and $X_B$ address electrodes will be referred to as DPA and DPB, respectively. In this instance, the voltage-falling times of the data pulses are shown to be the same, i.e. tdown =t5−t4 for both DPA and DPB. However, the voltage-rising times of the data pulses are different. As shown, tup for DPA is t2−t1 and tup for DPB is t3−t1. In other words, while the rising start time points of the voltage-rising transitions of DPA and DPB may be the same, the rising end time points are different. It is still preferred that the voltage-rising times of the two data pulses be 100 ns or longer, i.e. both t2−t1 and t3−t1 should be at least 100 ns. Furthermore, it is still preferred that the voltage-falling time, i.e. t5−t4, be 100 ns or longer for both data pulses.

In the situation depicted in FIG. 10 where the voltage-rising times tup of the data pulses DPA and DPB applied to the two address electrodes are different from each other, noise is further reduced. Such reduction of noise will be explained with reference to FIG. 11.

Figure 11:
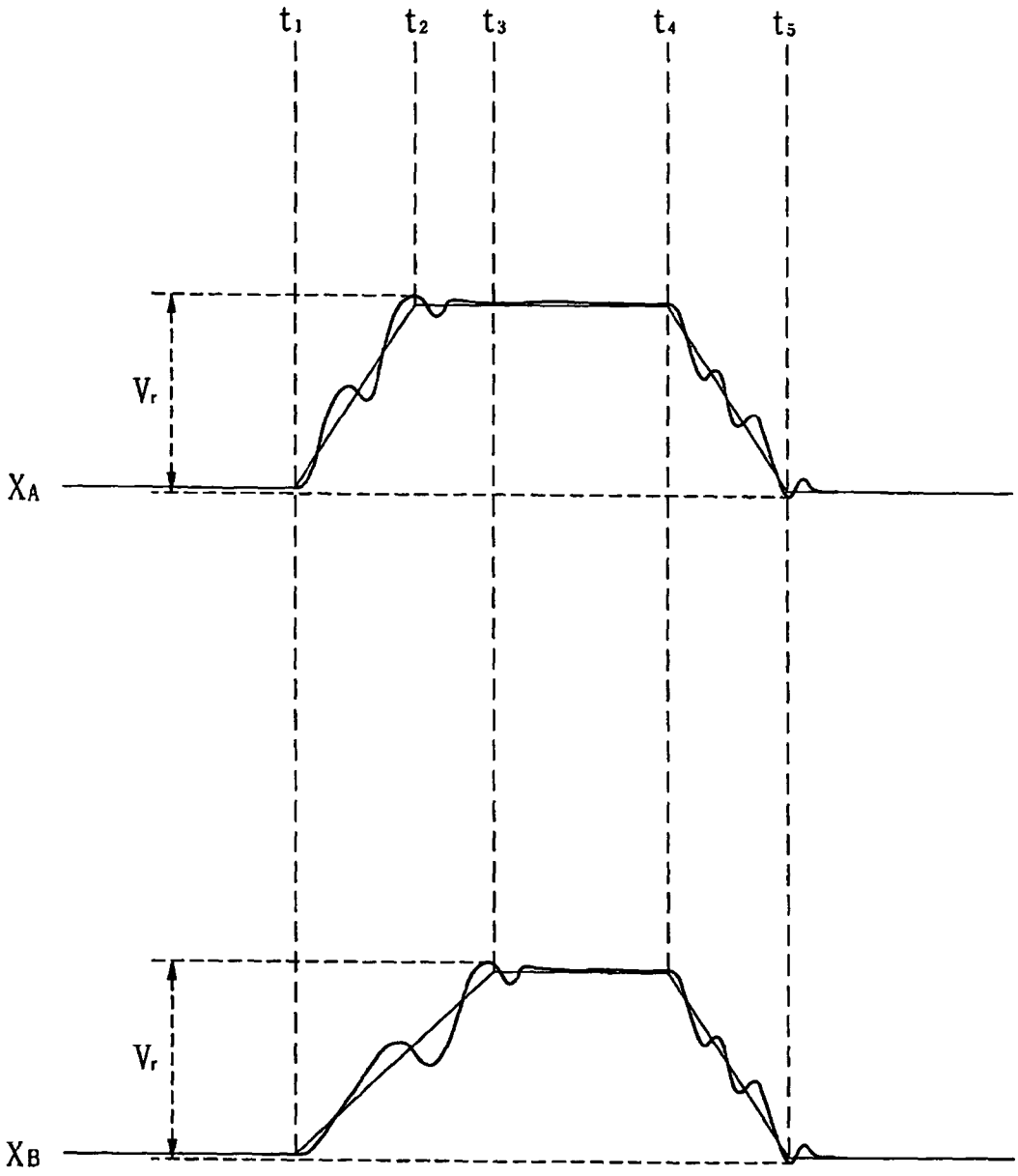
FIG. 11 is a view for explaining the noise reduction that results when the voltage-rising times of the data pulses applied to the two address electrodes are different from each other.

Referring to FIG. 11, when the voltage-rising times tup of the data pulses DPA and DPB are different from each other, the noise is further reduced. For example, as shown in FIG. 11, regarding the data pulse DPA, the noise generated between the time points t1 and t2 is reduced. Similarly, regarding the data pulse DPB, the noise generated between the time points t1 and t3 is reduced. The noise reduction is mainly due to a reduction of coupling of the data pulses when the voltage-rising times of the data pulses differ from each other.

It should be noted that even if the voltage-rising times tup for one or both data pulses are not set to be 100 ns or longer, noise reduction can still be achieved in relation to the related art apparatus, by setting the tup times to be different for the different data pulses. Further, a difference of the tup times of the two data pulses, that is the duration t3−t2, could be set to some predetermined minimum value or longer—such as 100 ns—to further reduce the coupling effects.

Just as noise can be reduced by applying data pulses with differing voltage-rising times, noise reduction can also be achieved by applying data pulses with differing voltage-falling times to the two address electrodes. This method will be described with reference to FIG. 12. Again, only two electrodes are illustrated for simplicity.

Figure 12:
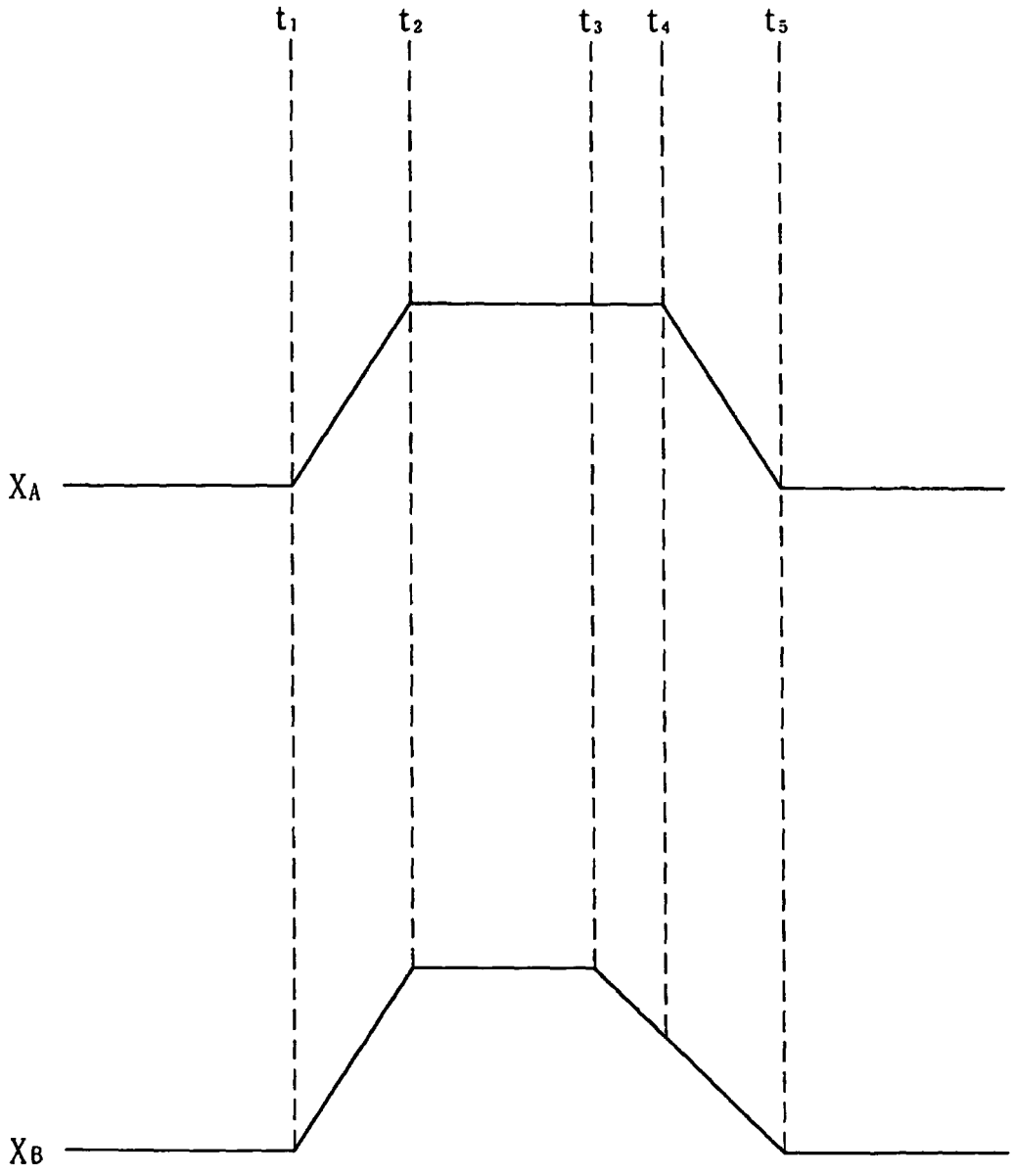
FIG. 12 is a view for explaining a difference between voltage-falling times of data pulses applied to two address electrodes according to an embodiment of the present invention.

Referring to FIG. 12, the voltage-falling times tdown of the data pulses DPA and DPB applied respectively to two address electrodes $X_A$ and $X_B$ are different from each other. As shown in FIG. 12, DPA begins rising at the time point t1, reaches the maximum value at the time point t2, begins falling at the time point t4, and then reaches the minimum value at the time point t5. DPB also begins rising at the time point t1 and reaches the maximum value at the time point t2, but begins falling at the time point t3, and then reaches the minimum value at the time point t5. That is, the voltage-rising times tup are the same, but voltage-falling times tdown are different. In other words, while the falling end time points of the voltage-falling transitions of DPA and DPB may be the same, the falling start time points are different. More specifically, the tdown time of DPA is t5−t4 and the tdown time of DPB is t5−t3. It is still preferred that the voltage-rising times (t2−t1) and falling times (t5−t3 and t5−t3) of both data pulses be 100 ns or longer.

Figure 13:
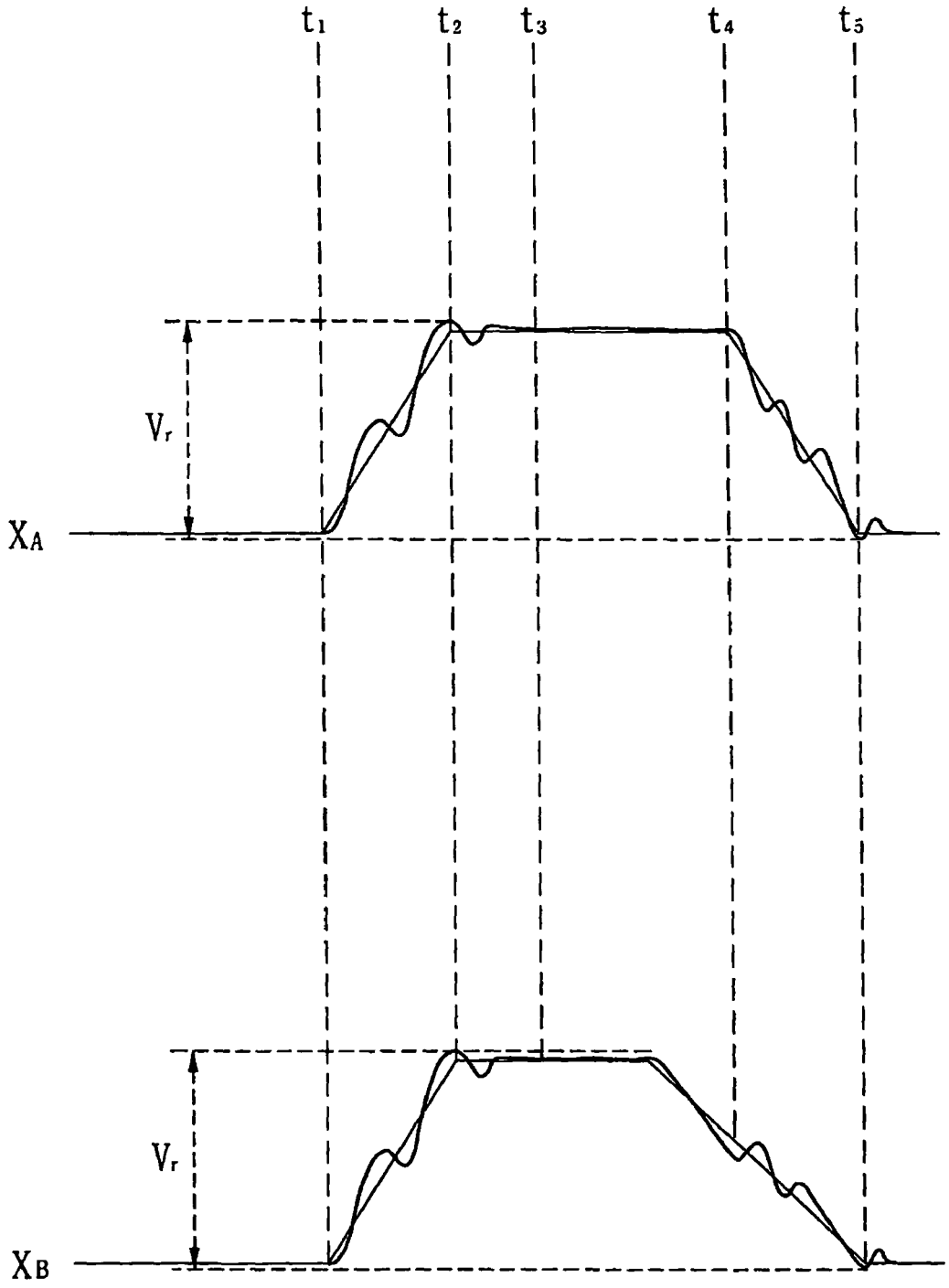
FIG. 13 is a view for explaining the noise reduction that results when the voltage-falling times of the data pulses applied to the two address electrodes are different from each other.

In the situation depicted in FIG. 12 where the tdown times of the data pulses applied to the two address electrodes are different from each other, noise is further reduced. Such reduction of noise will be explained with reference to FIG. 13. In FIG. 13, it can be seen that the noise is further reduced compared with that of FIG. 9. Again, the noise reduction results due to lessening of the coupling of the data pulses.

Again, it is to be noted that even if the tdown times for one or both data pulses are not set to be 100 ns or longer, noise reduction can still be achieved when compared to the related art apparatus, by setting the tdown times to be different for the different data pulses. Further, a difference of the tdown times of the two data pulses, that is the duration t4−t3, could be set to some predetermined minimum value or longer—such as 100 ns—to further reduce the coupling effects.

Figure 14:
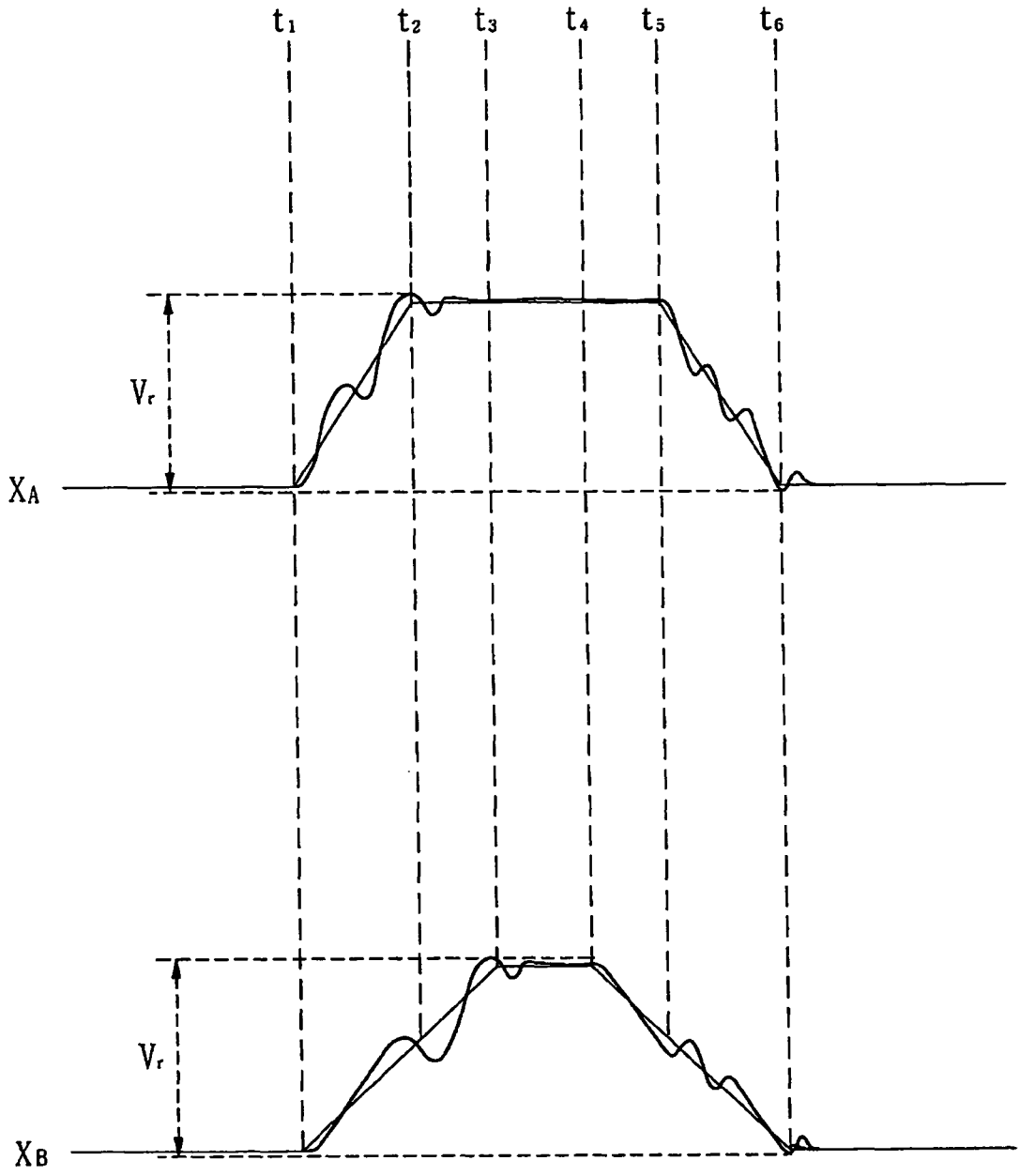
FIG. 14 is a view for explaining a method in which voltage-falling times and voltage-rising times of the data pulses applied to the two address electrodes are different from each other according to an embodiment of the present invention.

Of course, both the tup and tdown times of the data pulses can be different. This method will be described with reference to FIG. 14. As shown in FIG. 14, when both the tup and tdown times of the data pulses are different from each other, noise can be reduced even further than when only one of the tup and tdown times differ. Even in the case of FIG. 14, it is still preferred that the tup and tdown times of the data pulses DPA and DPB be 100 ns or longer.

The particulars of the driving waveform of FIG. 14 have been described in detail in the description of FIGS. 10 to 13. Description thereof will be thus omitted in order to avoid redundancy.

In FIG. 14, a situation is illustrated where both the tup and tdown times for the data pulse DPA are less than the corresponding times for the data pulse DPB. However, the invention is not so limited. It is well within the scope of the invention where DPA's tup is longer than DPB's tup and DPA's tdown time is shorter than that of DPB. To state it another way, the order of the voltage-rising times need not be related to the order voltage-falling times for the data pulses.

In the above description, the tup and tdown times of the data pulses are compared between two address electrodes. Again, the invention is not so limited. As indicated previously, the plurality of address electrodes can be divided into a plurality of address electrode groups where each group includes at least one address electrode and a different data pulse may be applied to each group. Indeed, each address electrode can receive a unique data pulse. An exemplary embodiment of method illustrating groups will now be described with reference to FIG. 15.

Figure 15:
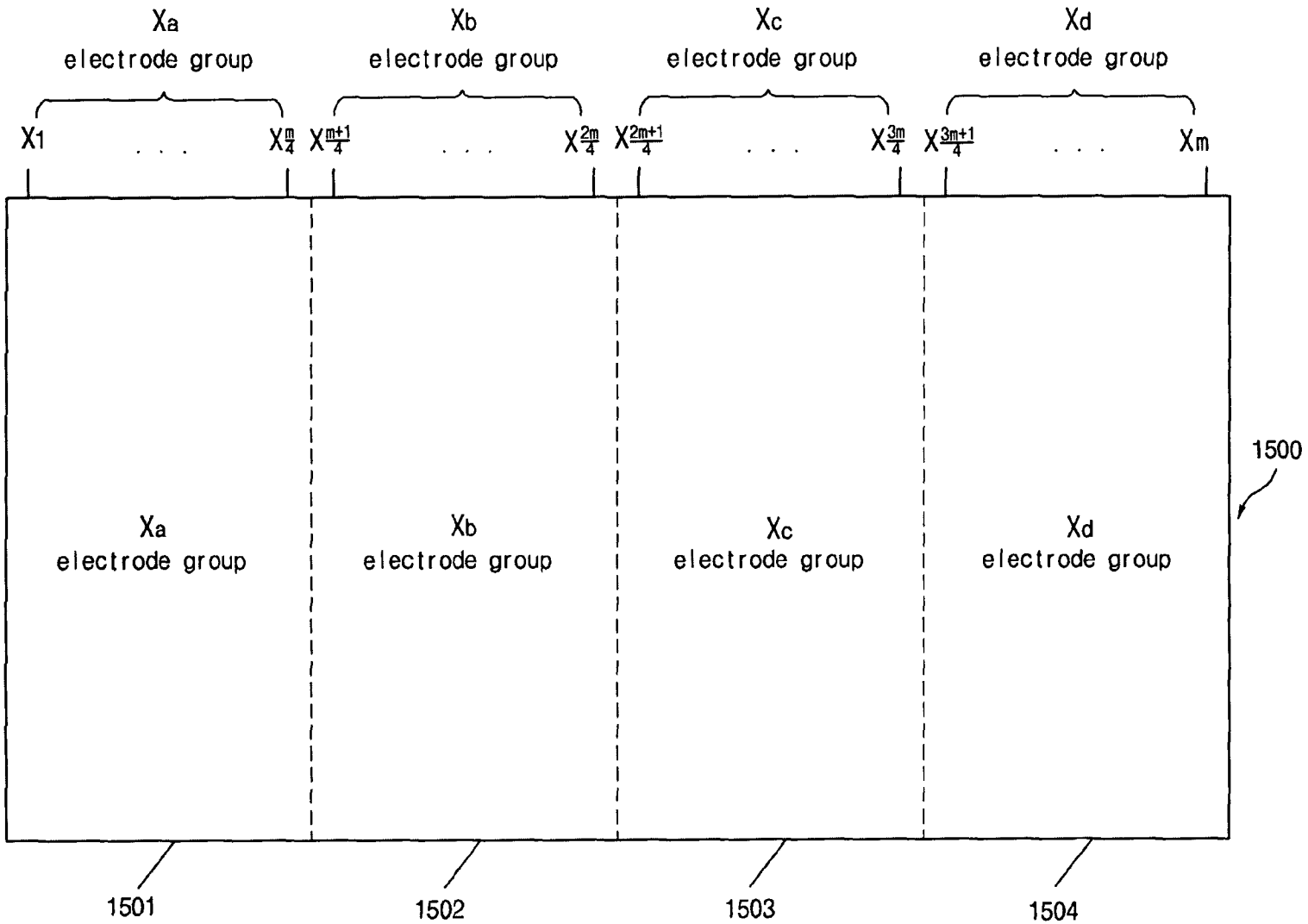
FIG. 15 is a view showing a grouping of address electrodes to explain a method of driving a plasma display panel according to an embodiment of the present invention.

As shown in FIG. 15, address electrodes X1 to Xm of a plasma display panel 1500 are divided into electrode groups Xa (electrodes X1 to X(m/4)) 1501, Xb (electrodes X((m/4)+1) to X(2 m/4)) 1502, Xc (electrodes X((2 m/4)+1) to X(3 m/4)) 1503, and Xd (electrodes X((3 m/4)+1) to Xm) 1504. The number of the address electrode groups ranges from 2 to the total number of address electrodes, i.e., $2 \leqq N \leqq m$, where the total number of address electrodes is m. The number of the address electrode groups is preferably between 4 and 8 when factors such as the size of data drive ICs for driving the address electrodes are considered. It is also preferred that one address electrode group includes between 100 and 100 address electrodes.

Note that the address electrodes included in one address electrode group need not to be consecutive. For example, there may be two address electrode groups with all odd-numbered address electrodes belonging to one address electrode group and all even-numbered address electrodes belonging to the other address electrode group.

In FIG. 15, the number of the address electrodes included in each of the address electrode groups 1501, 1502, 1503 and 1504 is illustrated as being equal for explanation simplicity. However, the invention is not so limited. In other words, the number of the address electrodes included in each of the address electrode groups 1501, 1502, 1503 and 1504 can be different. The number of the address electrode groups can also be controlled, which will be described in more detail later on.

A method, in which the plurality of address electrodes are divided into the plurality of the address electrode groups and in which the tup and/or the tdown times of the data pulses applied to the address electrode groups are different, will be described with reference to FIG. 16, which is a view for explaining the voltage-rising times and the voltage-falling times of the data pulses for the situation depicted in FIG. 15.

Figure 16:
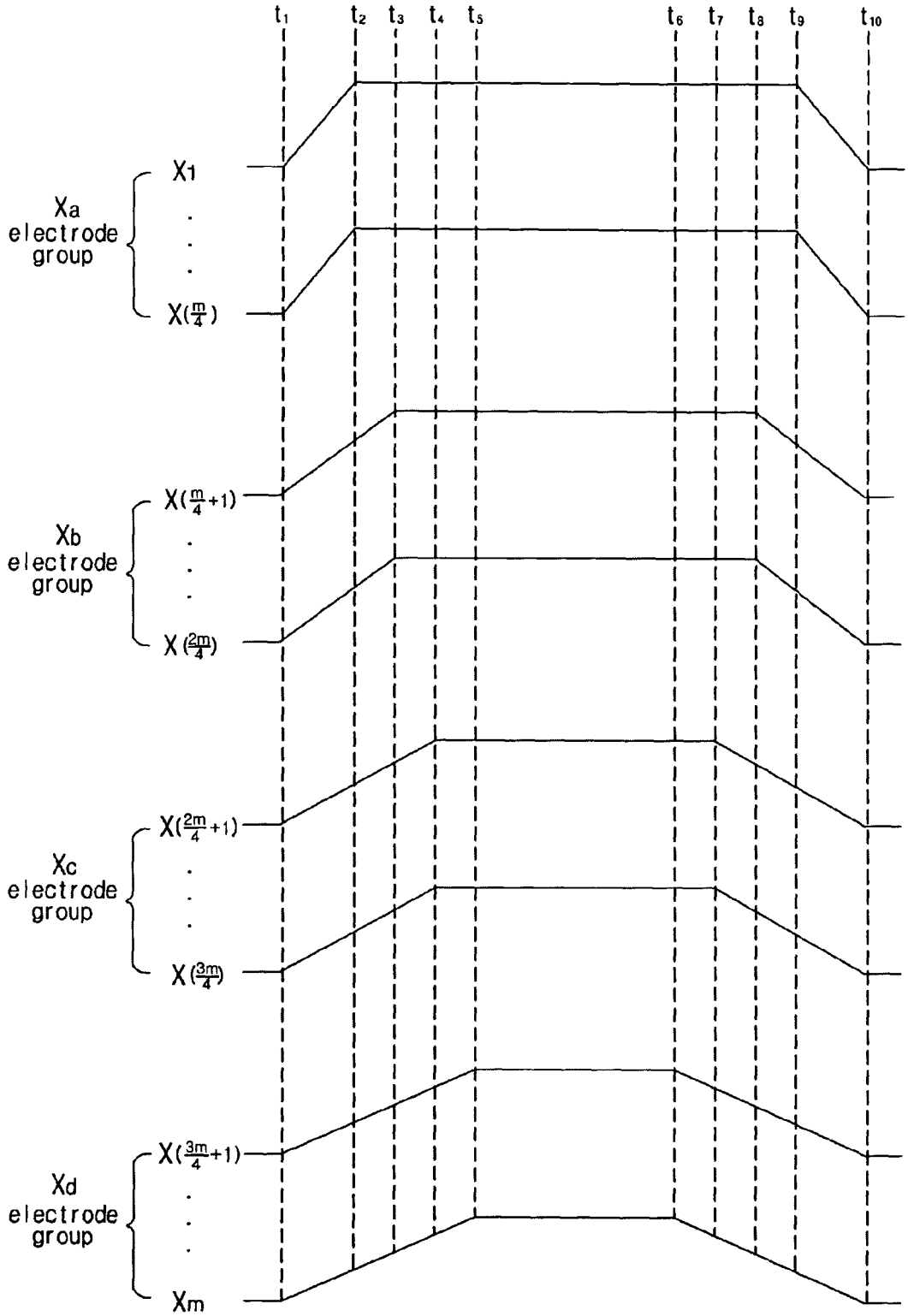
FIG. 16 is a view for explaining the voltage-rising time and the voltage-falling time of data pulses for the situation depicted in FIG. 15.

Referring to FIG. 16, the tup and tdown times of the data pulses applied to the plurality of address electrode groups are different from each other. In FIG. 16, a data pulse applied to the Xa address electrode group, i.e., the data pulse that is applied to address electrodes X1 to X(m/4) (referred to as DPGA for convenience), begins rising at a time point t1, reaches the maximum value at a time point t2, begins falling at a time point t9, and reaches the minimum value at a time point t10. The data pulse applied to the Xb address electrode group (referred to as DPGB) begins rising at the time point t1, reaches the maximum at a time point t3, begins falling at a time point t8, and reaches the minimum at the time point t10. The data pulse applied to the Xc address electrode group (referred to as DPGC) begins rising at the time point t1, reaches the maximum value at a time point t4, begins falling at a time point t7, and reaches the minimum value at the time point t10. The data pulse applied to the Xd address electrode group (referred to as DPGD) begins rising at the time point t1, reaches the maximum value at a time point t5, begins falling at a time point t6, and then reaches the lowest value at the time point t10. In other words, the tup times of the data pulses DPGA, DPGB, DPGC and DPGD are (t2−t1), (t3−t1), (t4−t1) and (t5−t1), respectively. As such, the voltage-rising times are different for every address electrode group. Furthermore, the tdown times of the data pulses DPGA, DPGB, DPGC and DPGD are (t10−t9), (t10−t8), (t10−t7) and (t10−t6), respectively. As such, the voltage-falling times are also different for every address electrode group.

In this instance, the voltage-rising times and the voltage-falling times of the data pulses applied to all address electrodes within each of the address electrode groups Xa and Xb and Xc and Xd are the same. For example, the DPGA data pulse is applied to all electrodes of the address electrode group Xa.

It is preferred that a difference between voltage-rising times of the data pulses be substantially regular. For example, the difference (t3−t2) between the tup times of DPGA and DPGB is preferred to be roughly equivalent to the difference (t4−t3) between the tup times of DPGB and DPGC. Similarly, it is preferred that (t5−t4) be roughly equivalent to (t4−t3).

It is also preferred that the differences in the tdown times be substantially regular. In other words, it is preferred that (t9−t8), (t8−t7) and (t7−t6) corresponding to the differences in the voltage-fallings times between DPGD and DPGC, DPGC and DPGB, and DPGB and DPGA, respectively, be roughly equivalent to each other.

It is preferred that the voltage-rising times tup and the voltage-falling times tdown of the data pulses applied to each of the address electrode groups be 100 ns or longer. It bears repeating that the order of the tup times are not dependent on the order of the tdown times for the data pulses.

Indeed, the tup and/or tdown times of the data pulse applied to one address electrode group may be same or different from one or more data pulses applied to other address electrode groups in an address period. Further, the data pulses can be controlled so that the data pulse applied to one electrode group in one address period need not have same characteristics to the data pulse applied to the same electrode group in another address period.

In the driving method in which the plurality of address electrodes are divided into the plurality of the address electrode groups, the subject of comparison is one address electrode group versus another address electrode group. As such, the situations as described with respect to FIGS. 8 to 14 in which one address electrode is compared with another address electrode may be expanded to cover the address electrode groups concept. Thus, description thereof will be omitted to minimize confusion and redundancy.

Referring back to FIG. 16, it is illustrated that the tup and tdown times of the data pulses increase according to the arrangement sequence of the address electrodes on the plasma display panel. However, invention is not so limited. The tup and tdown times of the data pulses can be set arbitrarily regardless of the arrangement sequence of the address electrodes. This driving method will be described with reference to FIG. 17.

Figure 17:
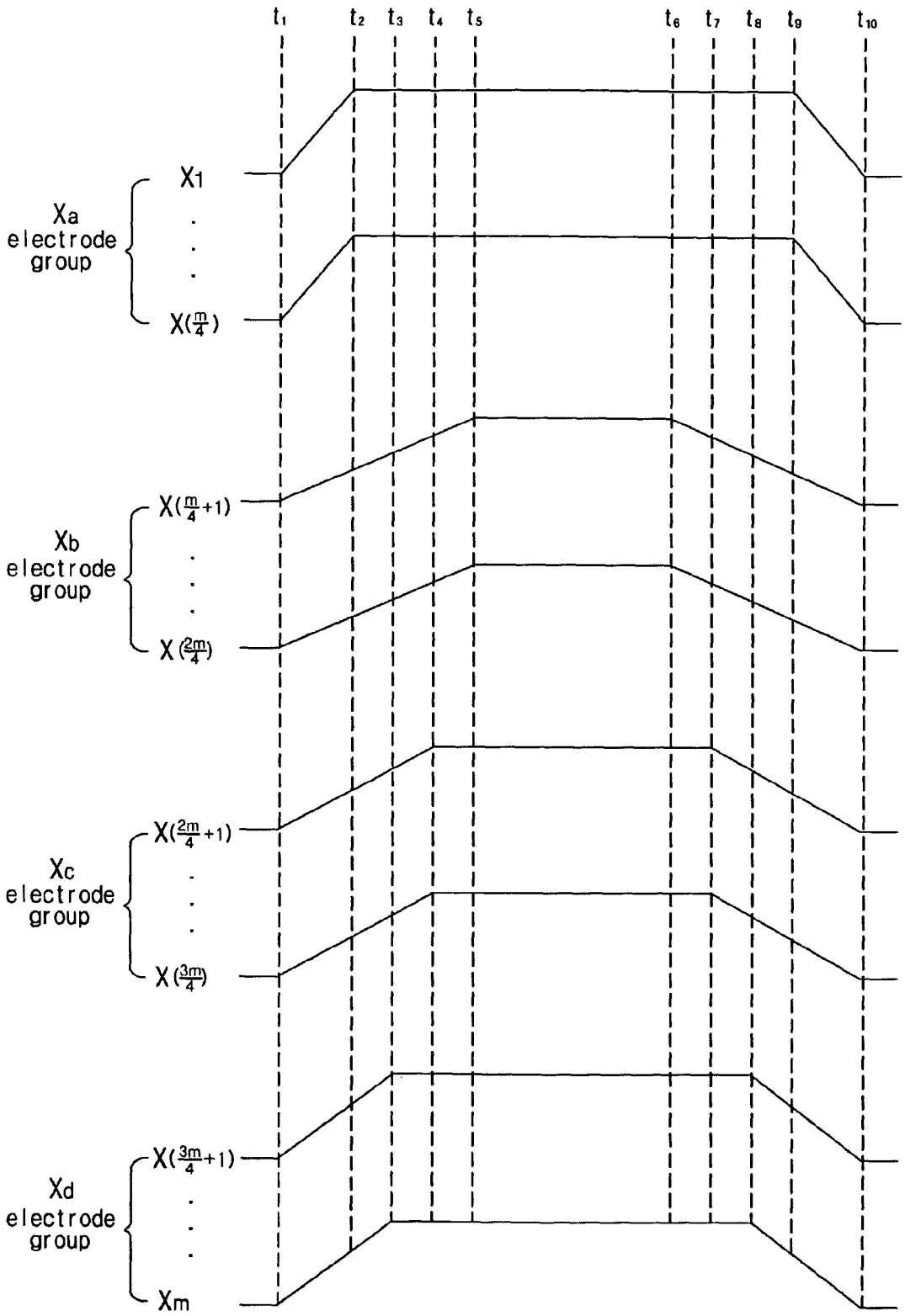
FIG. 17 is a view for explaining the relation between the arrangement sequence of address electrodes on the plasma display panel, and the voltage-rising time and the voltage-falling time of data pulses according to an embodiment of the present invention.

Referring to FIG. 17, unlike FIG. 16, DPGB—the data pulse applied to the Xb address electrode group—begins rising at the time point t1, reaches the maximum value at the time point t5, begins falling at the time point t6, and reaches the minimum value at the time point t10. The data pulse DPGD applied to the Xd address electrode group begins rising at the time point t1, reaches the maximum value at the time point t3, begins falling at the time point t8, and reaches the minimum value at the time point t10. That is, there is no relationship between the arrangement sequence of the address electrodes on the plasma display panel and timings of the data pulses. Due to the noise reduction achieved, it is simply preferred that the tup and tdown times of the data pulses applied to one address electrode groups be different from the tup and tdown times of other address electrode groups.

In FIGS. 15-17, examples in which the plurality of address electrodes being divided into the plurality of address electrode groups where the number of address electrodes in the groups being equal are illustrated. However, the invention is not so limited. The number of address electrodes in each group can be different as described with reference to FIG. 18.

Figure 18:
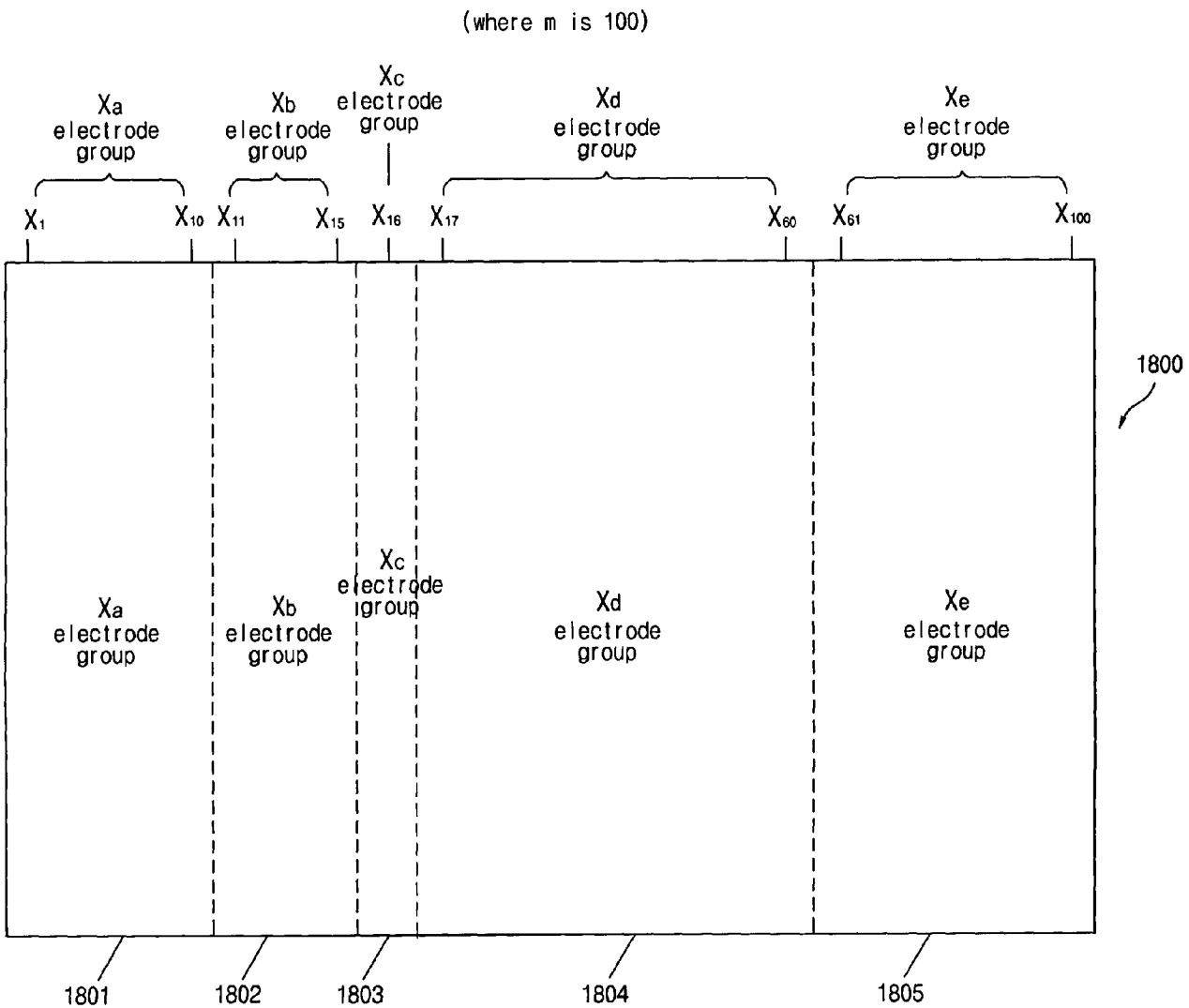
FIG. 18 is a view showing an example in which address electrodes formed in the plasma display panel are divided into address electrode groups including a different number of address electrodes per group according to an embodiment of the present invention.

As shown in FIG. 18, it is assumed that the total number of address electrodes of a plasma display panel 1800 is 100 and that the address electrodes X1 to X100 are divided into address electrode groups Xa, Xb, Xc, Xd and Xe. The address electrodes X1 to X10 belong to the group Xa 1801, electrodes X11 to X15 belong to the group Xb 1802, electrode X16 belongs to the group Xc 1803, electrodes X17 to X60 belong to the group Xd 1804, and electrodes X61 to X100 belong to the group Xe 1805. In other words, each of the address electrode groups includes a different number of the address electrodes. As mentioned previously, an address group can include only one address electrode. This is illustrated in FIG. 18 with the Xc address electrode group which has the X16 address electrode as the only address electrode in the group.

Regardless of whether the number of address electrodes in different address groups are the same or different, it is preferred that the data pulse applied to each group differ from the data pulse applied to any other group. In other words, the data pulses should differ from each other in the tup and/or tdown times to enhance the noise reduction.

In the above examples, the tup and tdown times of the data pulses are controlled without considering a width of the data pulse to reduce the noise. A method in which the tup and tdown times of the data pulses are controlled in consideration of the pulse width will now be described with reference to FIG. 19.

Figure 19:
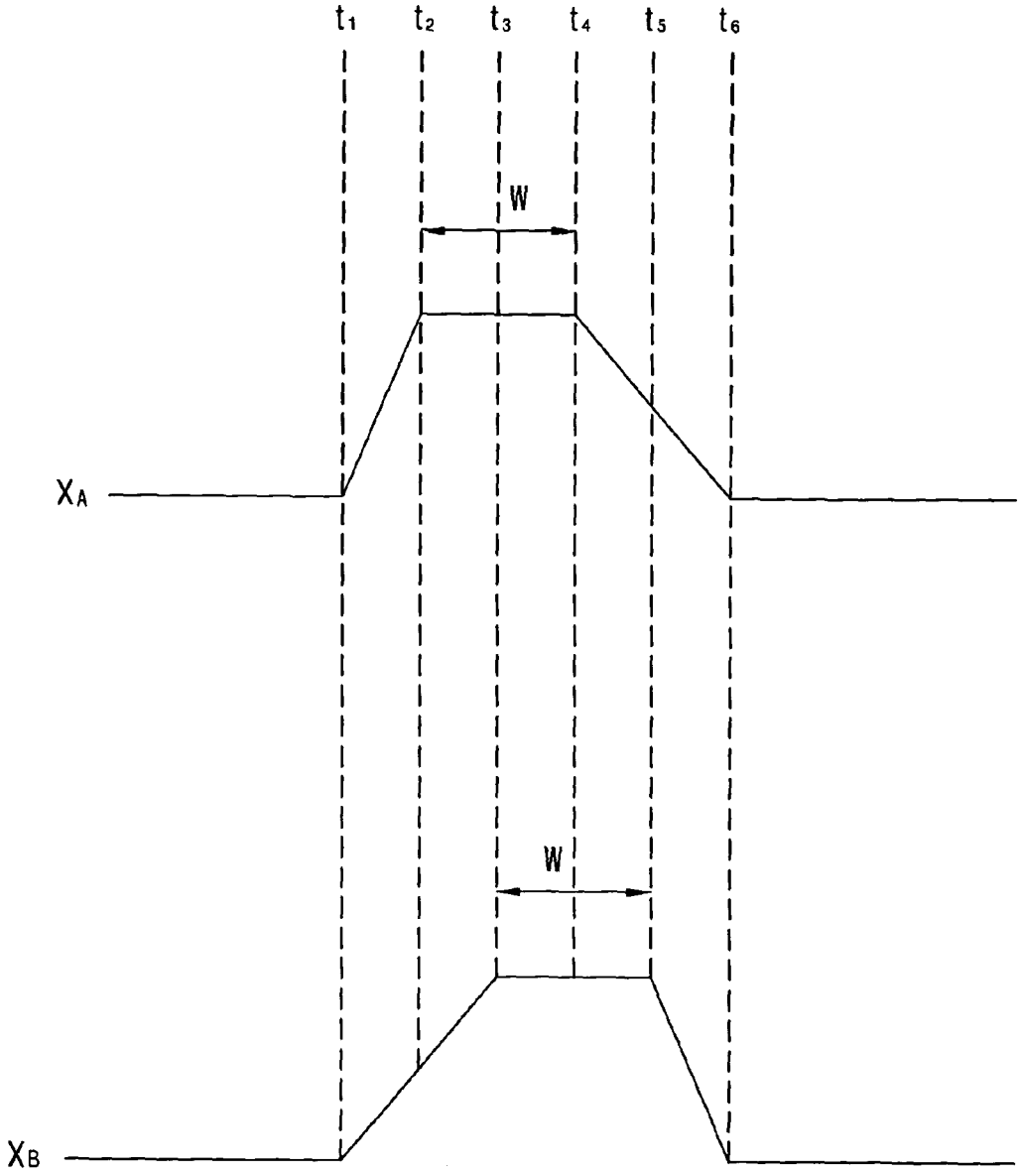
FIG. 19 is a view for explaining the voltage-rising time and the voltage-falling time of data pulses considering the pulse width of the data pulse according to an embodiment of the present invention.

Referring to FIG. 19, two different data pulses have the same pulse width, but have different tup and tdown times. Again for simplicity, only the data pulses applied to address electrodes $X_A$ and $X_B$ (respectively DPA and DPB) are shown in FIG. 19. But as noted above, the concept can be expanded to cover more than two data pulses and address electrode groups. As shown in FIG. 19, a pulse width of the data pulses DPA and DPB are substantially the same, namely W. More specifically, the duration in which each data pulse is at the maximum voltage, i.e. the high level duration, is substantially the same. To maintain the same pulse width W for both data pulses, it is seen that DPA has a shorter tup time and a longer tdown time compared to the corresponding times of DPB.

The purpose of maintaining the pulse width for duration W is so that the sufficient address discharge can be generated. For example, if the pulse width of the data pulse, i.e. the high duration, is less than some threshold, sufficient address discharge may not occur. Accordingly, the sustain discharge during the sustain period subsequent to the address period may be unstable. Indeed, the sustain discharge may not be generated in the sustain period. Thus, while controlling the tup and tdown times of the data pulse, the pulse width of the data pulses should also be maintained to generate sufficient address discharges. Thus, the width duration W is represents a minimum high level duration and the pulse width should be maintained at or longer than W.

The effectiveness of the noise reduction is enhanced when the number of channels, used to drive the data pulses to the address electrodes, included in the data drive IC is significant. Thus, it is preferred that the number of channels included in one data drive IC be relatively large, for example 150 or greater. As an illustration, if the number of channels included in one data drive IC is 10, then data drive IC is can be influenced by noise generated in the ten channels. But if one data drive IC includes 150 channels, it can be influenced by noise generated in the 150 channels. In other words, greater the number of channels included in one data drive IC, greater the amount of noise affecting the one data drive IC. Correspondingly, the embodiments of the present invention in which the voltage-rising times and the voltage-falling times of the data pulses are controlled to reduce noise are more effective when the number of channels included in one data drive IC is relatively large.

As such, where the number of channels included in one data drive IC is relatively large, it is preferred that the tup and/or the tdown times of the data pulses applied in the address period be controlled on a channel basis. This will be described with reference to FIG. 20, which is a view for explaining an exemplary method of controlling the tup and/or the tdown times of the data pulses applied to a plurality of channels included in one data drive IC.

Figure 20:
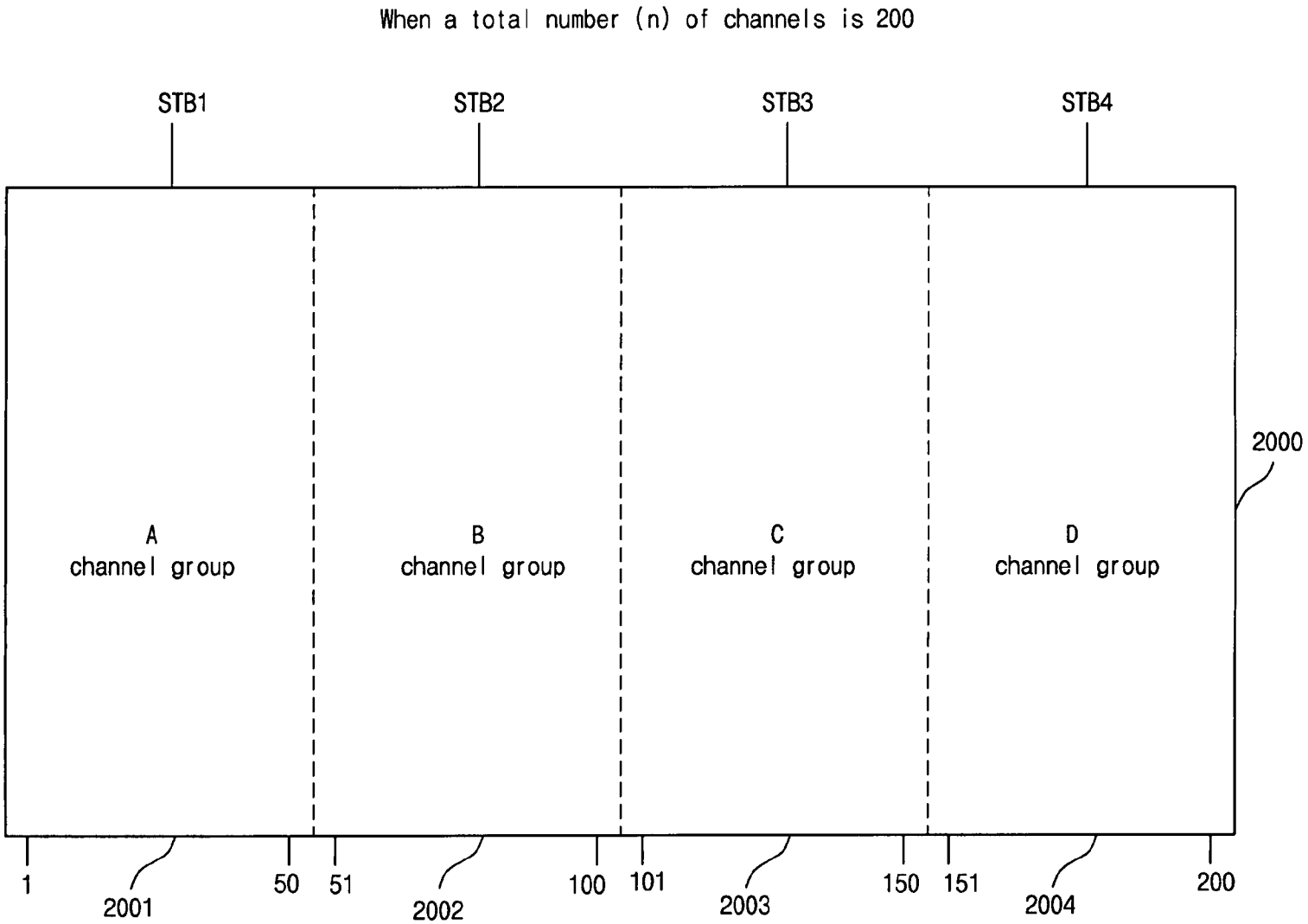
FIG. 20 is a view for explaining an example of a method of controlling one or more of a voltage-falling time and a voltage-rising time of data pulses applied to a plurality of channels included in one data drive IC according to an embodiment of the present invention.

Referring to FIG. 20, a data drive IC 2000 of a plasma display apparatus includes a plurality of channels. The channels are divided into an A channel group 2001, a B channel group 2002, a C channel group 2003 and a D channel group 2004 on the data drive IC 2000, and each of the channel groups applies data pulses having different tup and/or tdown times to a corresponding group of address electrodes. Control signals are provided to the channel groups through different strobe (STB) signals in order for each channel group to apply data pulses having different voltage-rising and/or voltage-falling times.

In FIG. 20, an example is shown where a total of 200 channels are formed on data drive IC 2000. A control signal STB1 is provided to the A channel group 2001 (which includes channels 1 to 50), a control signal STB2 is provided to the B channel group 2002 (for channels 51 to 100), a control signal STB3 is provided to the C channel group 2003 (for channels 101 to 150), and a control signal STB4 is provided to the D channel group 2004 (for channels 151 to 200). Based on the control signals STB1, the data drive IC 2000 controls the tup and tdown times of the data pulse DPA applied to the Xa group of electrodes (see FIG. 16) through the channels of the A channel group 2001. Like wise, the data drive IC 2000 controls the voltage-rising and the voltage-falling times of the data pulses DPB, DPC and DPD through the B channel group 2002, the C channel group 2003, and the D channel group 2004, respectively, based on the control signals STB2, STB3, and STB4, respectively. The number of lines of STB for supplying the control signals can vary depending upon the number of voltage-rising times of data pulse.

As described above, in accordance with a plasma display apparatus according to the embodiments of the present invention, the voltage-rising and/or the voltage-falling times of the data pulses applied to address electrodes in an address period are controlled to reduce noise generation. Accordingly, address discharge is stabilized, discharge efficiency of the plasma display panel is enhanced, and electrical damage to data drive ICs is prevented.

The invention being thus described, it is noted that the embodiments may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a data pulse controller configured to control an application of a data pulse in an address period to an address electrode of a plasma display panel, such that a voltage-rising duration of the data pulse is a predetermined minimum rising duration or longer, or a voltage-falling duration of the data pulse is a predetermined minimum falling duration or longer, or both, wherein one or both of the predetermined minimum rising duration and the predetermined minimum falling duration are substantially 100 ns, and a relationship between the voltage-rising duration and the voltage-falling duration of the data pulse is such that when the voltage-rising duration increases, the voltage-falling duration decreases and vice versa.

2. The apparatus of claim 1, wherein the voltage-rising duration of the data pulse is different from the voltage-falling duration of the data pulse.

3. The apparatus of claim 1, wherein a high level duration of the data pulse applied to the address electrode is a predetermined minimum high level duration or longer.

4. A plasma display apparatus, comprising:

a data pulse controller configured to control an application of a plurality of data pulses including a first data pulse and a second data pulse, both within a same address period, to a plurality of address electrodes of a plasma display panel, such that at least one of a voltage-rising duration of the first data pulse or a voltage-rising duration of the second data pulse is a predetermined minimum rising duration or longer, or at least one of a voltage-falling duration of the first data pulse or a voltage-falling duration of the second data pulse is a predetermined minimum falling duration or longer, or both, wherein the plurality of address electrodes are each grouped into one of a plurality of address electrode groups such that each address electrode group includes at least one address electrode, and the number of the address electrodes included in each address electrode group is substantially the same, the plurality of address electrode groups includes a first electrode group and a second electrode group, the first data pulse being applied to all electrodes of the first electrode group and the second data pulse being applied to all electrodes of the second electrode group, and the voltage-rising duration of the first data pulse is different from the voltage-rising duration of the second data pulse, or the voltage-falling duration of the first data pulse is different from the voltage-falling duration of the second data pulse, or both.

5. The apparatus of claim 4, wherein one or both of the predetermined minimum rising duration and the predetermined minimum falling duration for the respective first and second data pulses are substantially 100 ns.

6. The apparatus of claim 4, wherein the voltage-rising duration of the first data pulse is different from the voltage-falling duration of the first data pulse, or the voltage-rising duration of the second data pulse is different from the voltage-falling duration of the second data pulse, or both.

7. The apparatus of claim 4, wherein high level durations of both the first and second data pulses are a predetermined high level minimum duration or longer.

8. The apparatus of claim 7, wherein a relationship between the voltage-rising duration and the voltage-falling duration of the first and second data pulses is such that when the voltage-rising duration increases for the first data pulse, the voltage-falling duration decreases for the first data pulse and vice versa, or when the voltage-rising duration increases for the second data pulse, the voltage-falling duration decreases for the second data pulse and vice versa, or both.

9. The apparatus of claim 4, further comprising one or more data driving ICs, wherein each data driving IC is configured to supply one or both of the first and second data pulses to the address electrodes of one or both of the first and second address electrode groups.

10. The apparatus of claim 4, wherein rising end time points of voltage-rising transitions of the first and second data pulses are different from each other, or falling start time points of voltage-falling transitions of the first and second data pulses are different from each other, or both.

11. The apparatus of claim 10, wherein rising start time points of the voltage-rising transitions of the first and second data pulses are substantially the same when the rising end time points of voltage-rising transitions of the first and second data pulses are different from each other, or wherein falling end time points of the voltage-falling transitions of the first and second data pulses are substantially the same when the falling start time points of voltage-falling transitions of the first and second data pulses are different from each other, or both.

12. The apparatus of claim 10, wherein the plurality of address electrode groups further includes at least a third electrode group, and wherein the data pulse controller is configured to control an application of a third data pulse, within the same address period, to all electrodes within the third electrode group such that when rising end time points of voltage-rising transitions of the first, second and third data pulses are all different from each other, intervals between the rising end time points of the first, second, and third data pulses are substantially equal, or when falling start time points of voltage-falling transitions of the first, second and third data pulses are all different from each other, intervals between the falling start time points of the first, second, and third data pulses are substantially equal, or both.

13. A plasma display apparatus, comprising:

a data pulse controller configured to control an application of a data pulse in an address period to an address electrode of a plasma display panel, such that a voltage-rising duration of the data pulse is different from the voltage-falling duration of the data pulse, wherein the address electrode is a first address electrode of the plasma display panel and the data pulse applied to the first address electrode is a first data pulse, and the data pulse controller is configured to control an application a second data pulse to a second address electrode of the plasma display panel such that the voltage-rising duration of the first data pulse is different from a voltage-rising duration of the second data pulse, or the voltage-falling duration of the first data pulse is different from a voltage-falling duration of the second data pulse, or both.

14. A method to control plasma display apparatus, comprising:

applying, within a same period, a plurality of data pulses including a first data pulse and a second data pulse to a plurality of address electrodes of a plasma display panel, such that at least one of a voltage-rising duration of the first data pulse or a voltage-rising duration of the second data pulse is a predetermined minimum rising duration or longer, or at least one of a voltage-falling duration of the first data pulse or a voltage-falling duration of the second data pulse is a predetermined minimum falling duration or longer, or both, wherein the plurality of address electrodes are each grouped into one of a plurality of address electrode groups such that each address electrode group includes at least one address electrode, and the number of the address electrodes included in each address electrode group is substantially the same, the plurality of address electrode groups includes a first electrode group and a second electrode group, the first data pulse being applied to electrodes of the first electrode group and the second data pulse being applied to electrodes of the second electrode group, one or both of the predetermined minimum rising duration and the predetermined minimum falling duration for the respective first and second data pulses are substantially 100 ns, and the one or both of the predetermined minimum rising duration and the predetermined minimum falling duration for the respective first and second data pulses being substantially 100 ns reduces noise of the respective first and second data pulses during the voltage-rising duration or the voltage-falling duration, respectively.

15. The method of claim 14, wherein the voltage-rising duration of the first data pulse is different from the voltage-falling duration of the first data pulse, or the voltage-rising duration of the second data pulse is different from the voltage-falling duration of the second data pulse, or both.

16. The apparatus of claim 1, wherein the one or both of the predetermined minimum rising duration and the predetermined minimum falling duration being substantially 100 ns reduces noise of the data pulse during the voltage-rising duration or the voltage-falling duration, respectively.

17. The apparatus of claim 5, wherein the one or both of the predetermined minimum rising duration and the predetermined minimum falling duration for the respective first and second data pulses being substantially 100 ns reduces noise of the respective first and second data pulses during the voltage-rising duration or the voltage-falling duration, respectively.

18. A plasma display apparatus, comprising:

a data pulse controller configured to control an application of a plurality of data pulses including a first data pulse and a second data pulse, both within a same address period, to a plurality of address electrodes of a plasma display panel, such that at least one of a voltage-rising duration of the first data pulse or a voltage-rising duration of the second data pulse is a predetermined minimum rising duration or longer, or at least one of a voltage-falling duration of the first data pulse or a voltage-falling duration of the second data pulse is a predetermined minimum falling duration or longer, or both, wherein the plurality of address electrodes are each grouped into one of a plurality of address electrode groups such that each address electrode group includes at least one address electrode, and the number of the address electrodes included in each address electrode group is substantially the same, the plurality of address electrode groups includes a first electrode group and a second electrode group, the first data pulse being applied to all electrodes of the first electrode group and the second data pulse being applied to all electrodes of the second electrode group, wherein rising end time points of voltage-rising transitions of the first and second data pulses are different from each other, or falling start time points of voltage-falling transitions of the first and second data pulses are different from each other, or both, and the plurality of address electrode groups further includes at least a third electrode group, wherein the data pulse controller is configured to control an application of a third data pulse, within the same address period, to all electrodes within the third electrode group such that when rising end time points of voltage-rising transitions of the first, second and third data pulses are all different from each other, intervals between the rising end time points of the first, second, and third data pulses are substantially equal, or when falling start time points of voltage-falling transitions of the first, second and third data pulses are all different from each other, intervals between the falling start time points of the first, second, and third data pulses are substantially equal, or both.

* * * * *